US009680215B2

(12) United States Patent
Su et al.

(10) Patent No.: US 9,680,215 B2
(45) Date of Patent: Jun. 13, 2017

(54) OMNIDIRECTIONAL BROADBAND ANTENNAS INCLUDING CAPACITIVELY GROUNDED CABLE BRACKETS

(71) Applicant: Laird Technologies, Inc., Earth City, MO (US)

(72) Inventors: Choon Chung Su, Perak (MY); Kok Jiunn Ng, Perak (MY); Henrik Karl Ramberg, Manchester, NH (US)

(73) Assignee: Laird Technologies, Inc., Earth City, MO (US)

( * ) Notice: Subject to any disclaimer, the term of this patent is extended or adjusted under 35 U.S.C. 154(b) by 114 days.

(21) Appl. No.: 14/804,655

(22) Filed: Jul. 21, 2015

(65) Prior Publication Data

US 2017/0025750 A1 Jan. 26, 2017

(51) Int. Cl.

| | |
|---|---|
| ***H01Q 9/40*** | (2006.01) |
| ***H01Q 9/28*** | (2006.01) |
| ***H01Q 1/48*** | (2006.01) |
| ***H01Q 1/36*** | (2006.01) |
| ***H01Q 5/378*** | (2015.01) |
| ***H01Q 1/50*** | (2006.01) |
| *H01Q 5/307* | (2015.01) |

(Continued)

(52) U.S. Cl.

CPC ..... *H01Q 1/48* (2013.01); *H01Q 1/36* (2013.01); *H01Q 1/50* (2013.01); *H01Q 5/378* (2015.01); *H01Q 9/40* (2013.01); *H01Q 5/25* (2015.01); *H01Q 5/307* (2015.01); *H01Q 9/0464* (2013.01); *H01Q 19/26* (2013.01); *H01Q 19/32* (2013.01)

(58) Field of Classification Search

CPC .. H01Q 1/36; H01Q 1/48; H01Q 5/25; H01Q 5/307; H01Q 9/02; H01Q 9/40; H01Q 9/0464; H01Q 19/32; H01Q 19/26

See application file for complete search history.

(56) References Cited

U.S. PATENT DOCUMENTS 7,193,582 B2 * 3/2007 Wang ..... H01Q 9/42 343/702
2006/0232490 A1 * 10/2006 Bisiules ..... H01Q 1/246 343/797

(Continued)

FOREIGN PATENT DOCUMENTS

| | | |
|---|---|---|
| CN | 204348913 U | 5/2015 |
| WO | WO 2015/041768 | 3/2015 |
| WO | WO 2015/069309 | 5/2015 |

OTHER PUBLICATIONS

Electromagnetics, by Kraus et al.*

(Continued)

*Primary Examiner* — Jessica Han
*Assistant Examiner* — Awat Salih
(74) *Attorney, Agent, or Firm* — Harness, Dickey & Pierce, P.L.C.

(57) ABSTRACT

Disclosed are exemplary embodiments of omnidirectional broadband antennas and capacitively grounded cable brackets. In an exemplary embodiment, an omnidirectional broadband antenna generally includes a ground element, an antenna element, an annular element, and a cable bracket capacitively grounded to the ground element. The cable bracket is configured to allow soldering of a cable braid to the cable bracket for feeding the antenna element without direct galvanic contact between the cable braid and the ground element.

18 Claims, 26 Drawing Sheets

(51) Int. Cl.

| | |
|---|---|
| *H01Q 9/04* | (2006.01) |
| *H01Q 5/25* | (2015.01) |
| *H01Q 19/32* | (2006.01) |
| *H01Q 19/26* | (2006.01) |

(56) References Cited

U.S. PATENT DOCUMENTS

2006/0284779 A1* 12/2006 Parsche ..... H01Q 21/29 343/773
2010/0033401 A1* 2/2010 Du ..... H01Q 1/007 343/893
2010/0085264 A1* 4/2010 Du ..... H01Q 21/28 343/772
2011/0134002 A1* 6/2011 Suto ..... H01Q 1/48 343/722
2011/0241965 A1 10/2011 Wu et al.
2013/0076584 A1* 3/2013 Wong ..... H01Q 1/007 343/786
2013/0135161 A1* 5/2013 Fujimoto ..... H01Q 1/3233 343/725
2014/0022131 A1* 1/2014 Azulay ..... H01Q 1/007 343/727
2015/0015447 A1* 1/2015 Yona ..... H01Q 1/48 343/786
2015/0042536 A1* 2/2015 Emerick ..... H01Q 9/40 343/843
2015/0048990 A1* 2/2015 Feller ..... H01Q 1/36 343/848
2015/0123868 A1* 5/2015 Bit-Babik ..... H01Q 9/0464 343/857
2015/0123869 A1* 5/2015 Bit-Babik ..... H01Q 3/247 343/857
2015/0145741 A1* 5/2015 Moulder ..... H01Q 13/02 343/775
2015/0255874 A1* 9/2015 Hung ..... H01Q 5/357 343/786
2015/0311593 A1* 10/2015 Fasenfest ..... H01Q 13/02 343/786
2016/0344106 A1* 11/2016 Rankin ..... H01Q 19/18

OTHER PUBLICATIONS

European search report dated Dec. 16, 2016 for European application No. 16167323.1 which claims priority to the instant application, 8 pages.

* cited by examiner

Elevation Plane, Phi=90°

Elevation Plane, Phi=0°

Azimuth Plane, Theta=60°

2100 MHZ

5000 MHZ

OMNIDIRECTIONAL BROADBAND ANTENNAS INCLUDING CAPACITIVELY GROUNDED CABLE BRACKETS

FIELD

The present disclosure relates to omnidirectional broadband antennas including capacitively grounded cable brackets.

BACKGROUND

This section provides background information related to the present disclosure which is not necessarily prior art.

Omnidirectional antennas may include an inverted cone or shorted inverted cone, which provides very good omnidirectional radiation patterns over a broad bandwidth. But it can be very challenging to design and build an omnidirectional antenna for low Passive Intermodulation (PIM), which is dependent on the frequency range of the antenna. Typical PIM level specifications of in-building antennas may be −150 dBC (decibels relative to carrier) with two tone carriers of 43 dBm (decibels-milliwatts).

DRAWINGS

The drawings described herein are for illustrative purposes only of selected embodiments and not all possible implementations, and are not intended to limit the scope of the present disclosure.

Figure 1:
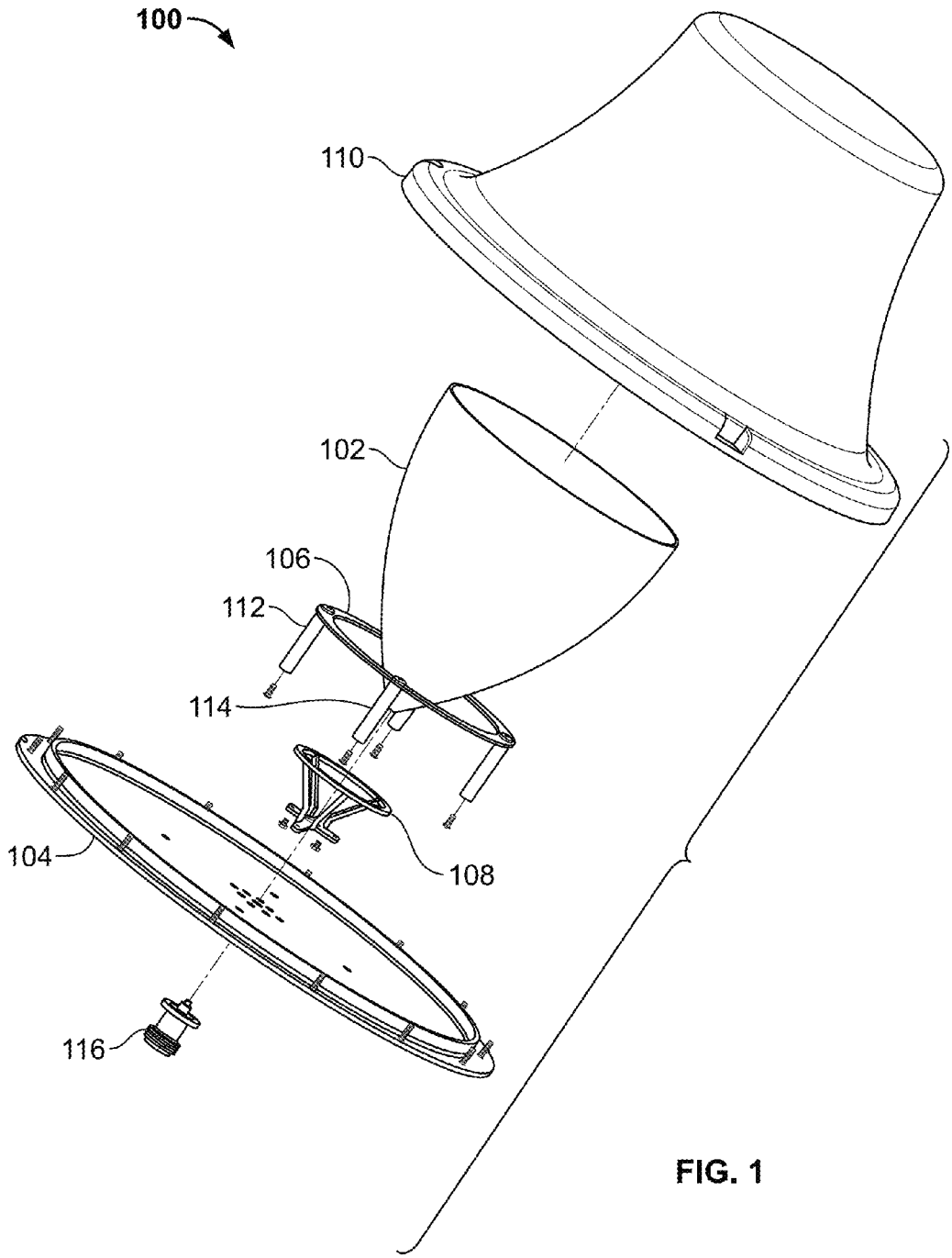
FIG. 1 is an exploded perspective view of an omnidirectional broadband antenna according to an exemplary embodiment.
Figure 2:
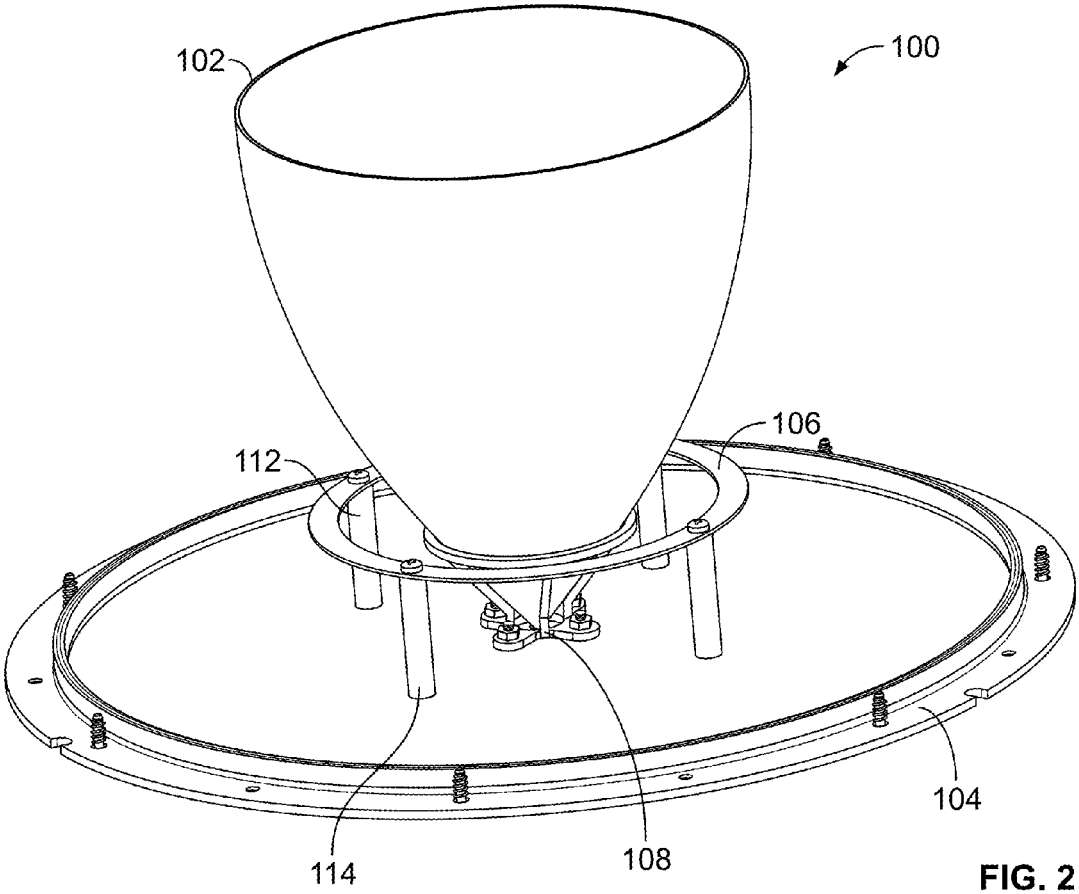
FIG. 2 is a perspective view of the exemplary antenna shown in FIG. 1 after the components have been assembled together, where the radome is not shown for clarity.
Figure 3:
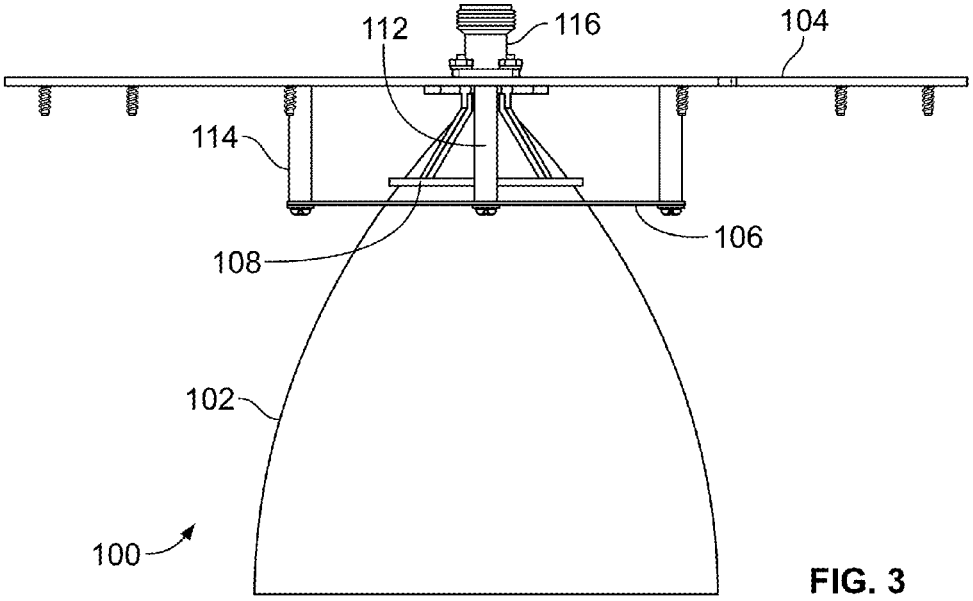
FIG. 3 is a side view of the exemplary antenna shown in FIG. 2.
Figure 9A:
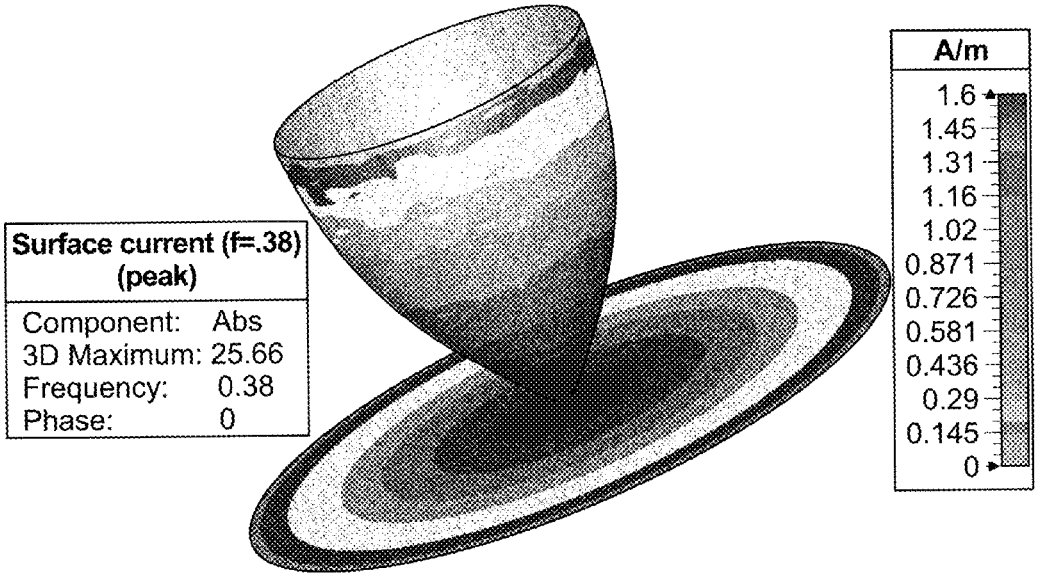
Figure 9B:
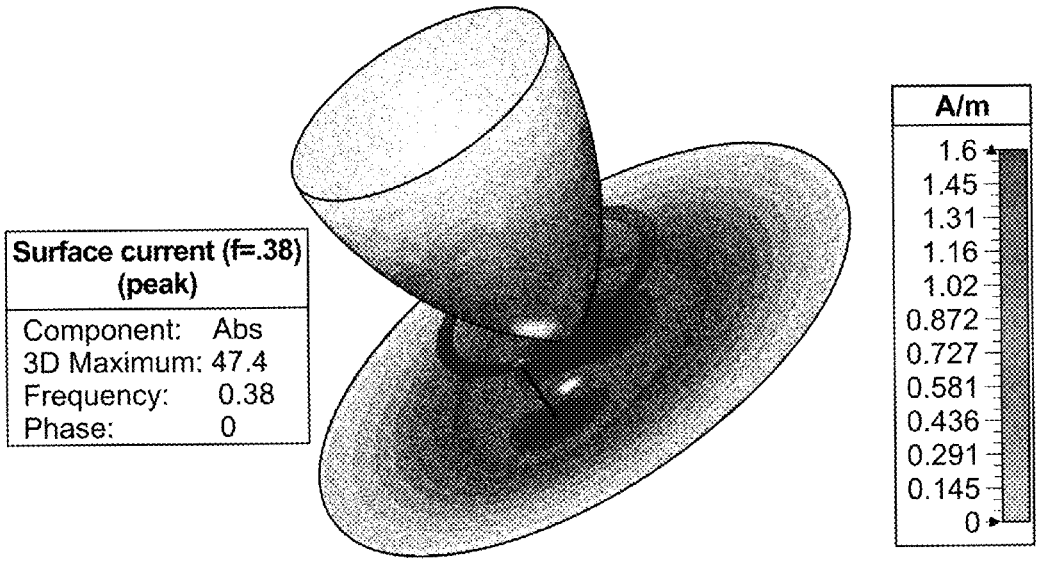
Figure 10A:
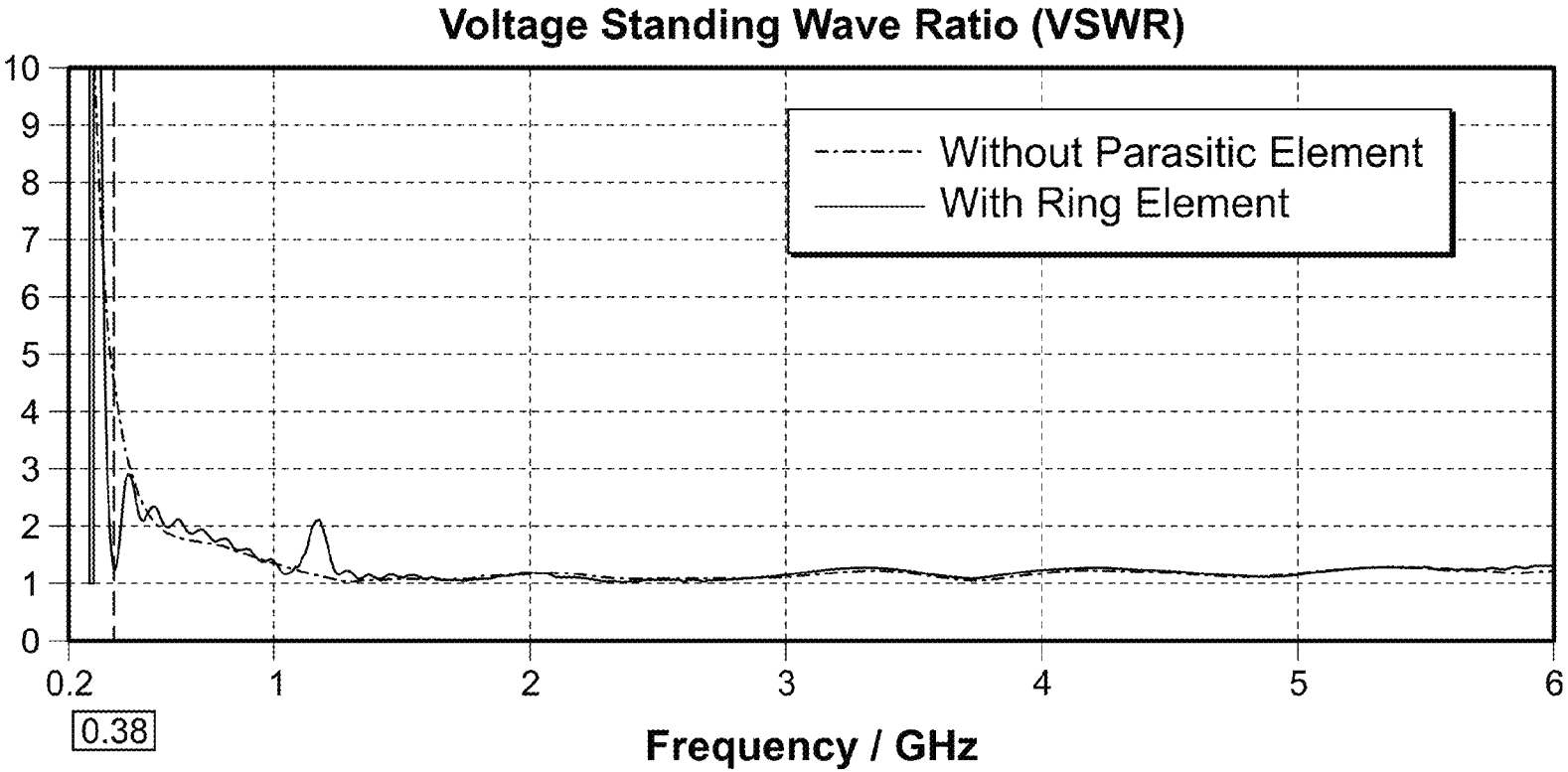
Figure 10B:
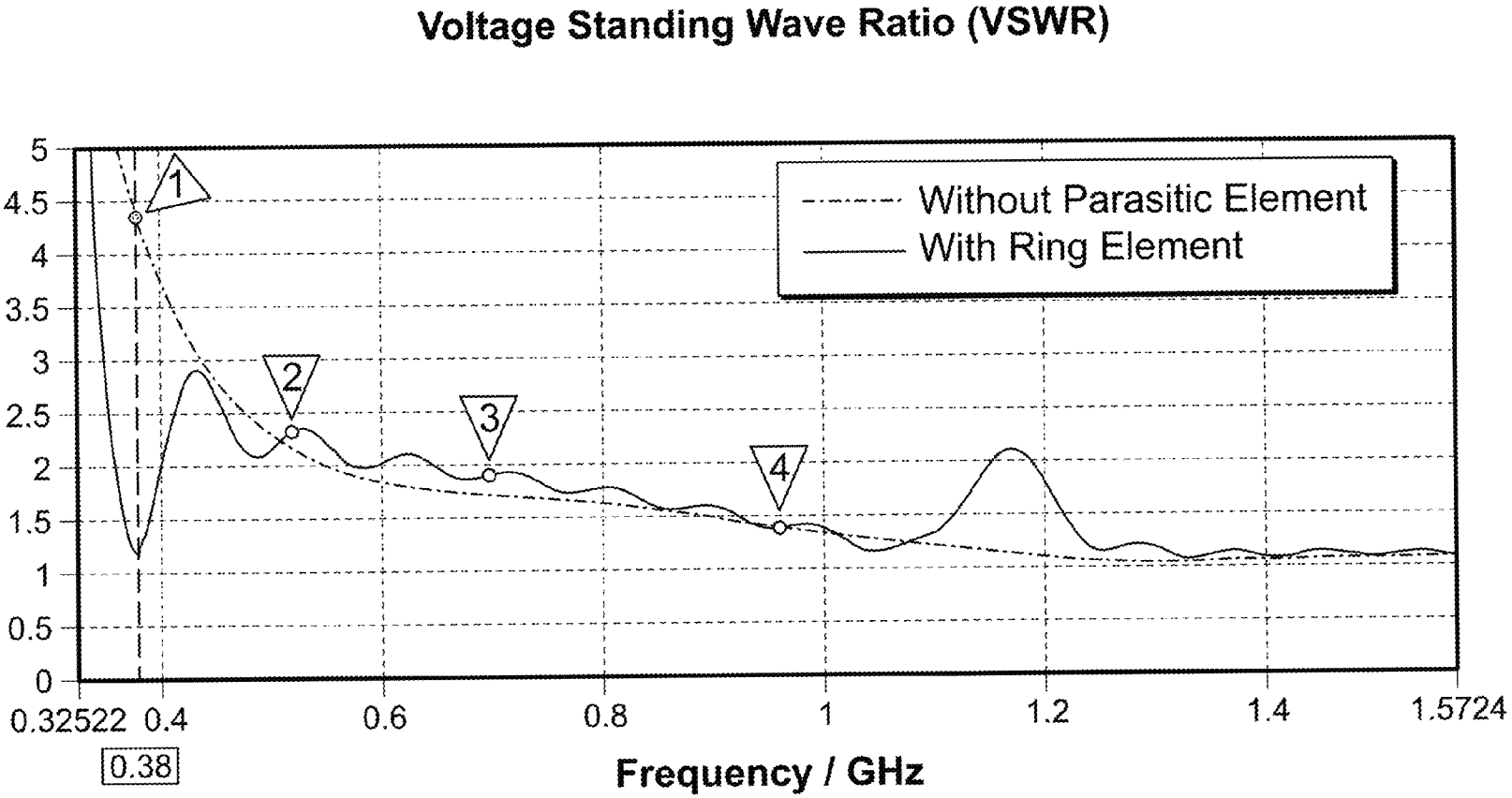
Figure 12A:
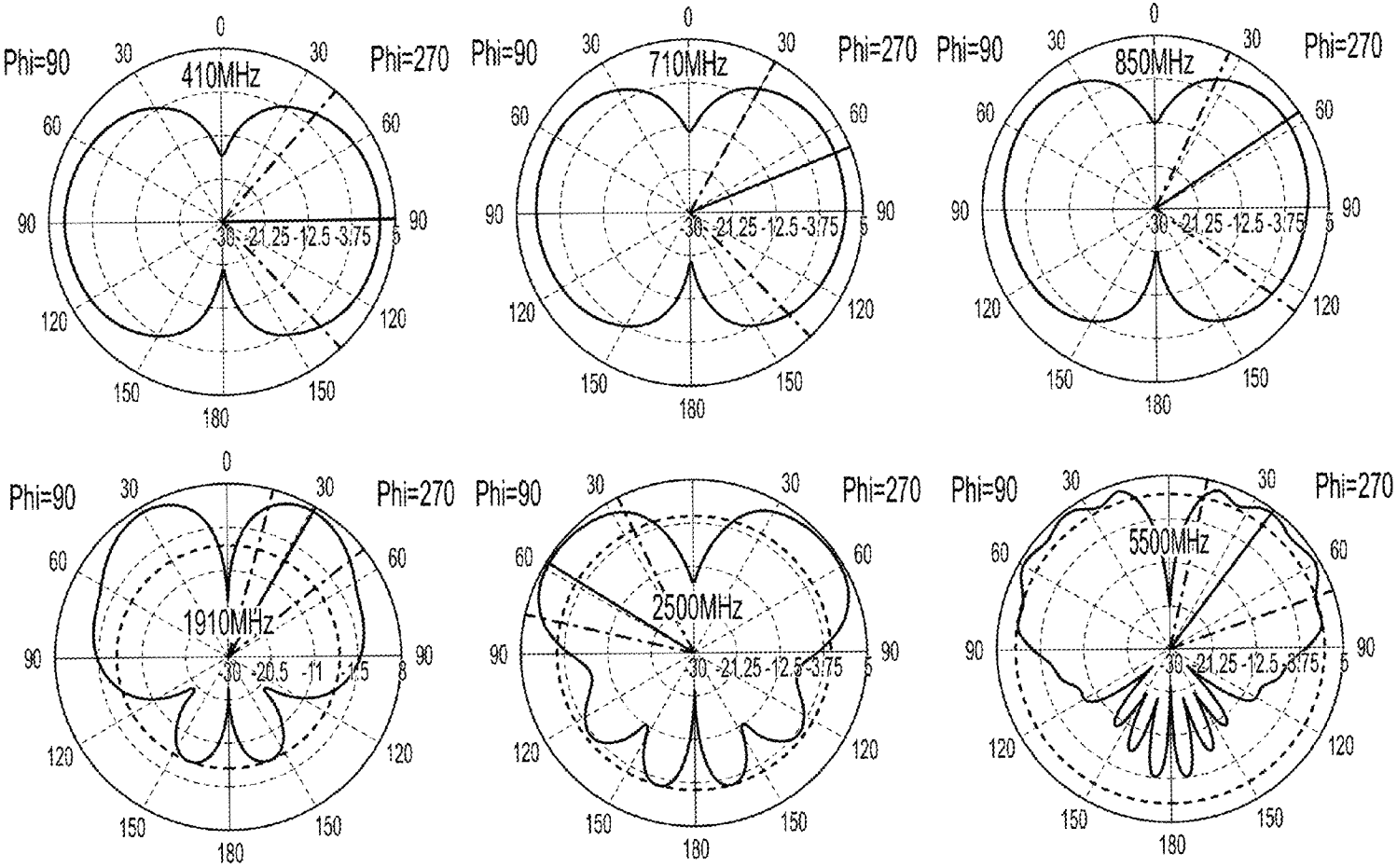
Figure 12B:
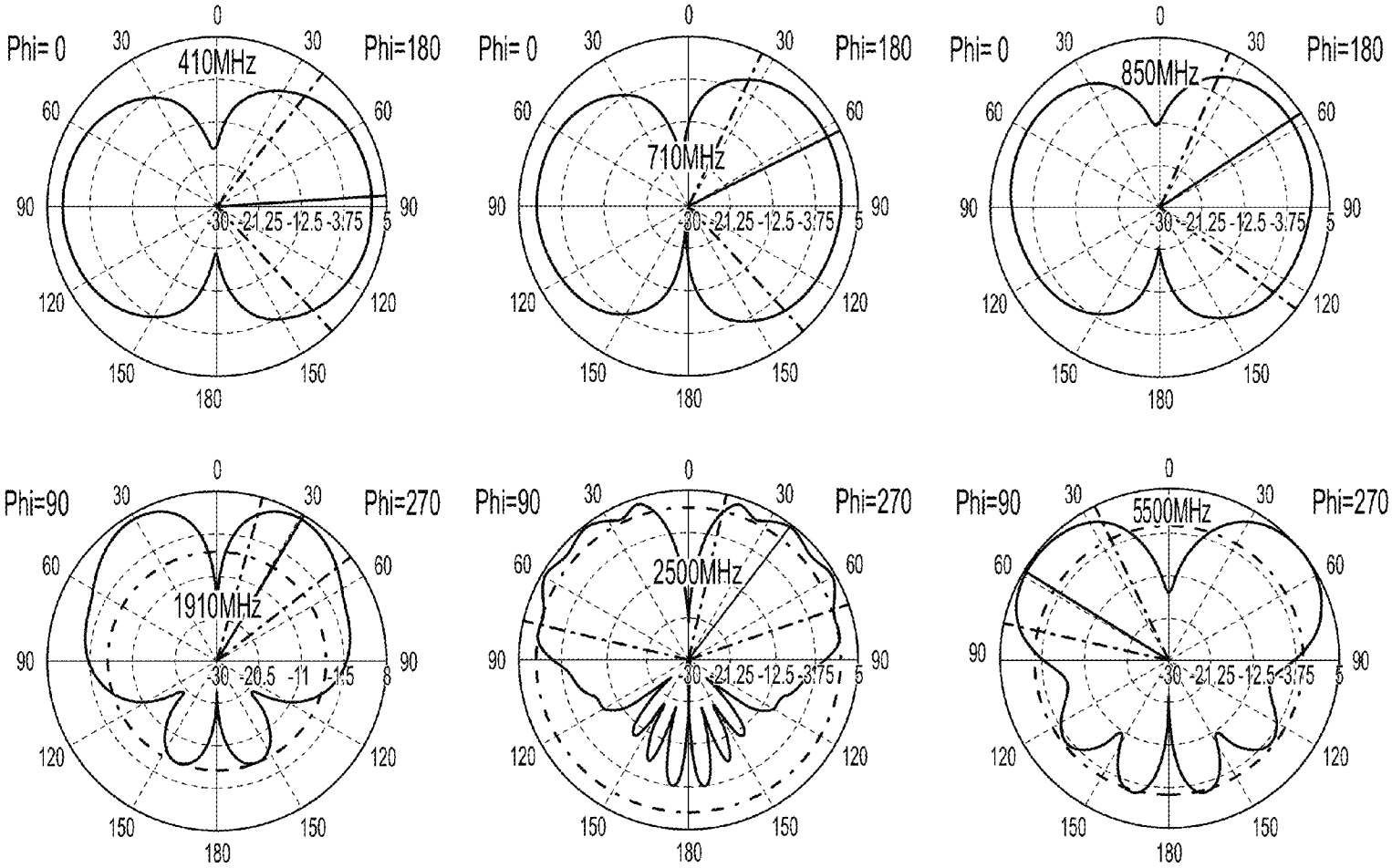
Figure 12C:
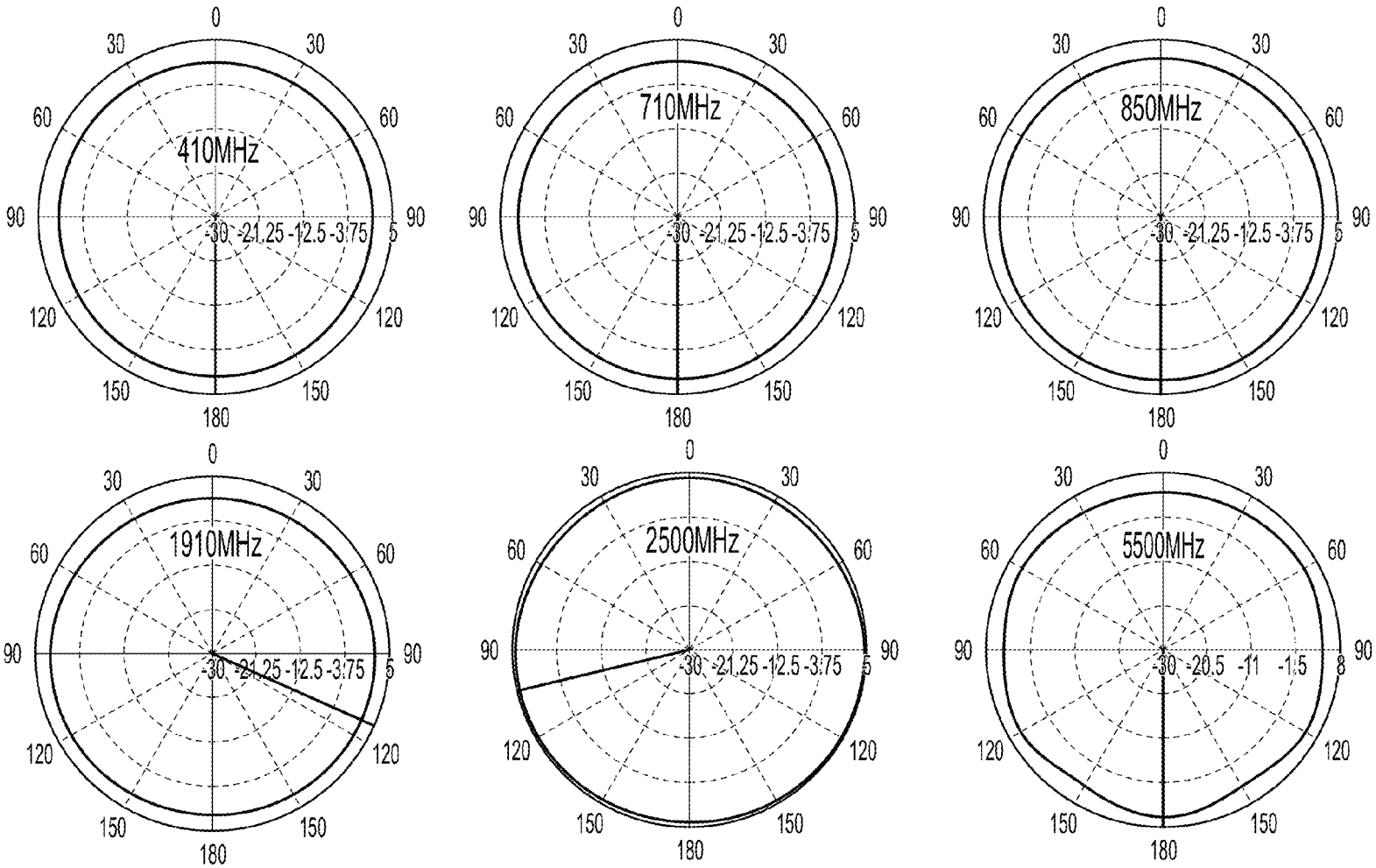
Figure 13:
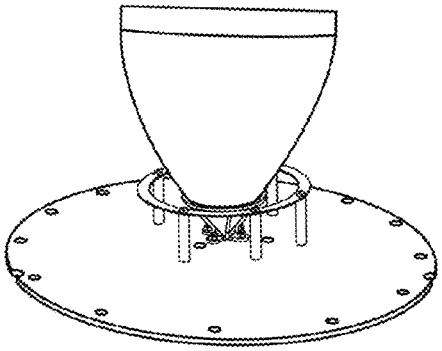
Figure 14:
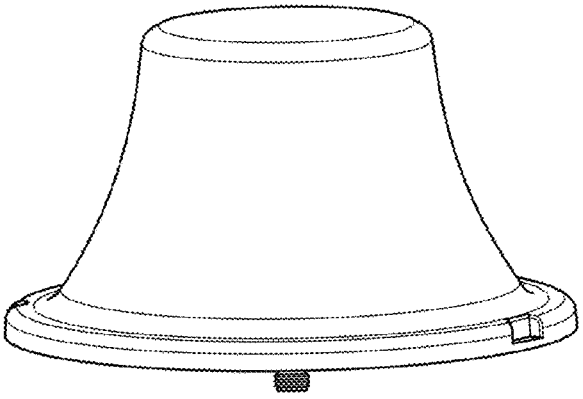
Figure 15:
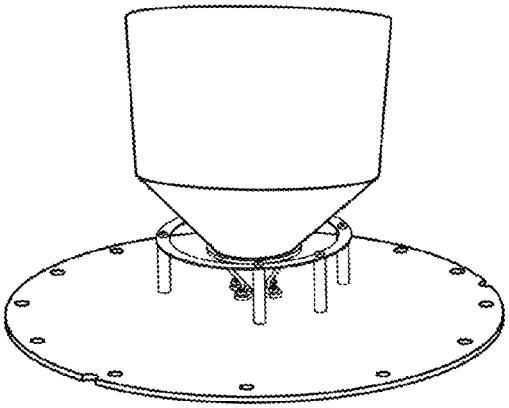
Figure 16:
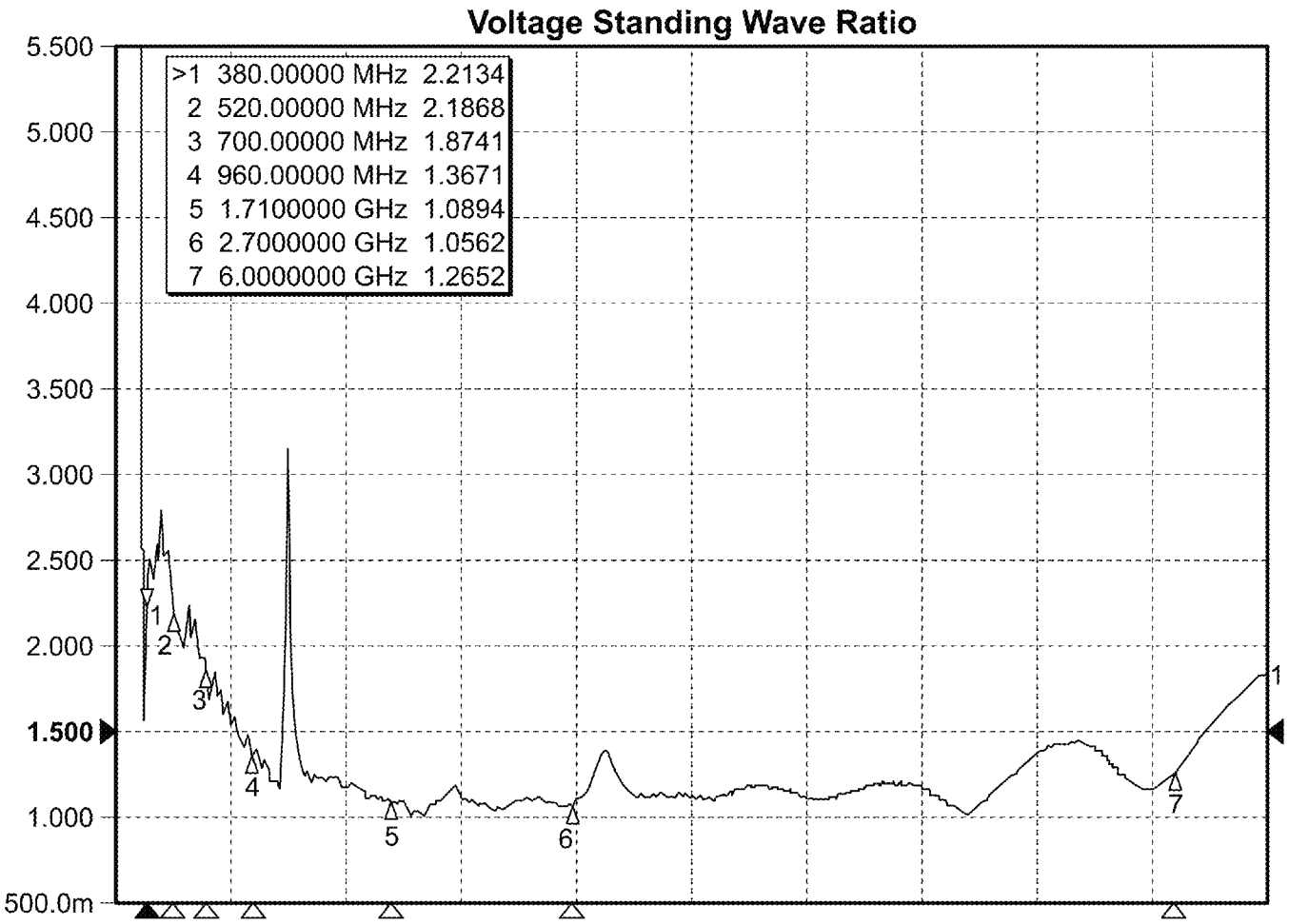
Figure 17:
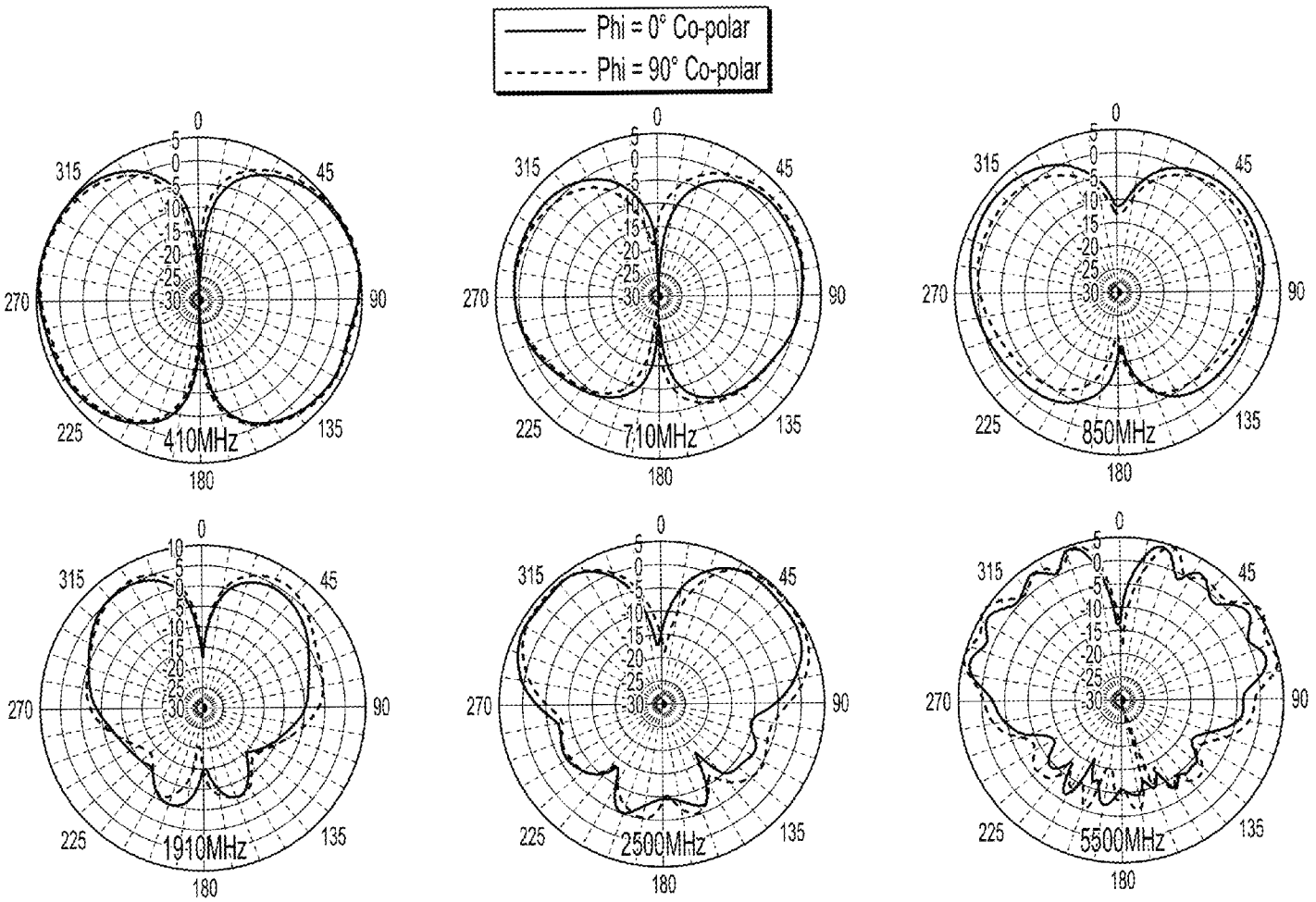
Figure 18:
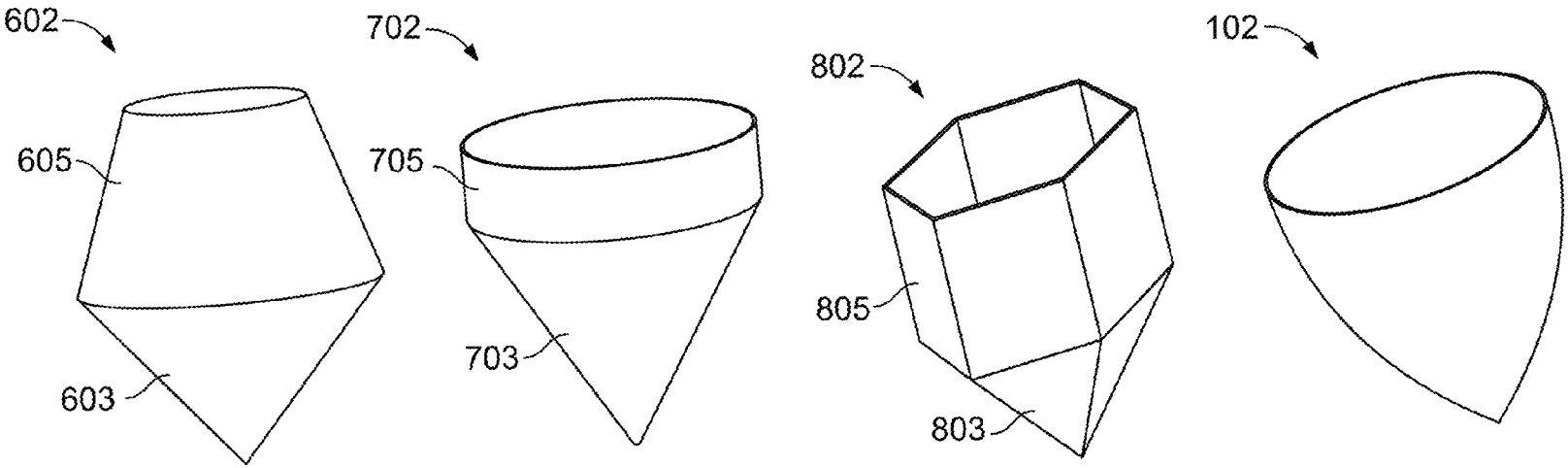
Figure 19:
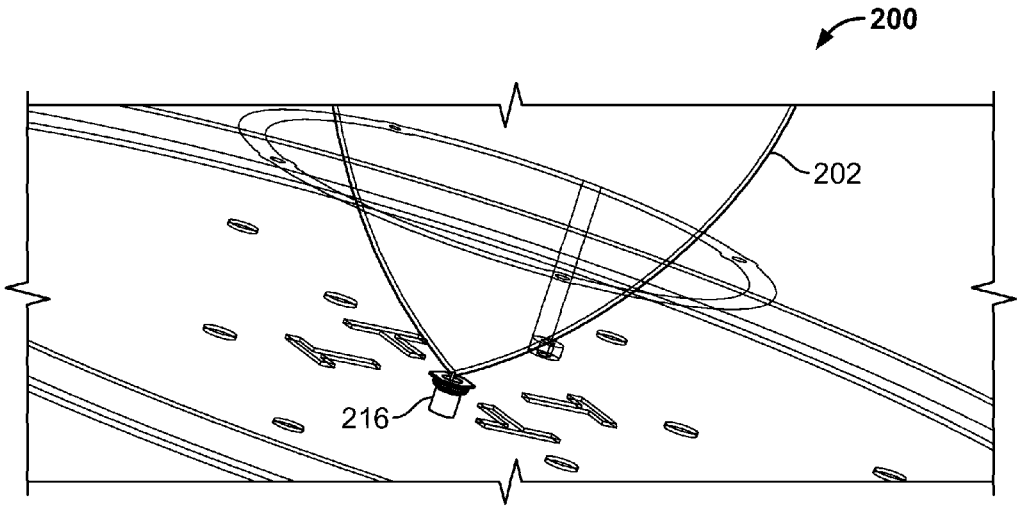
Figure 20:
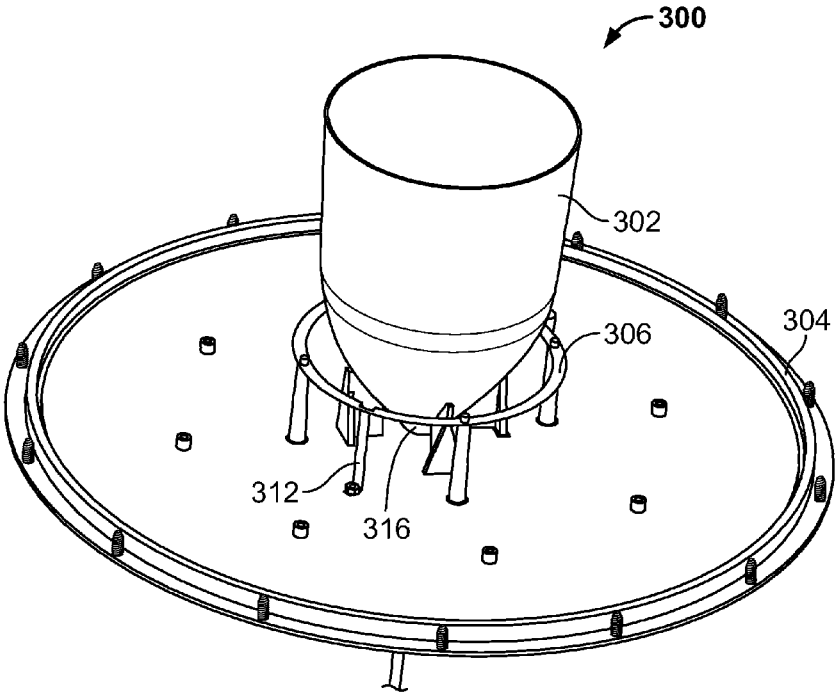
Figure 21:
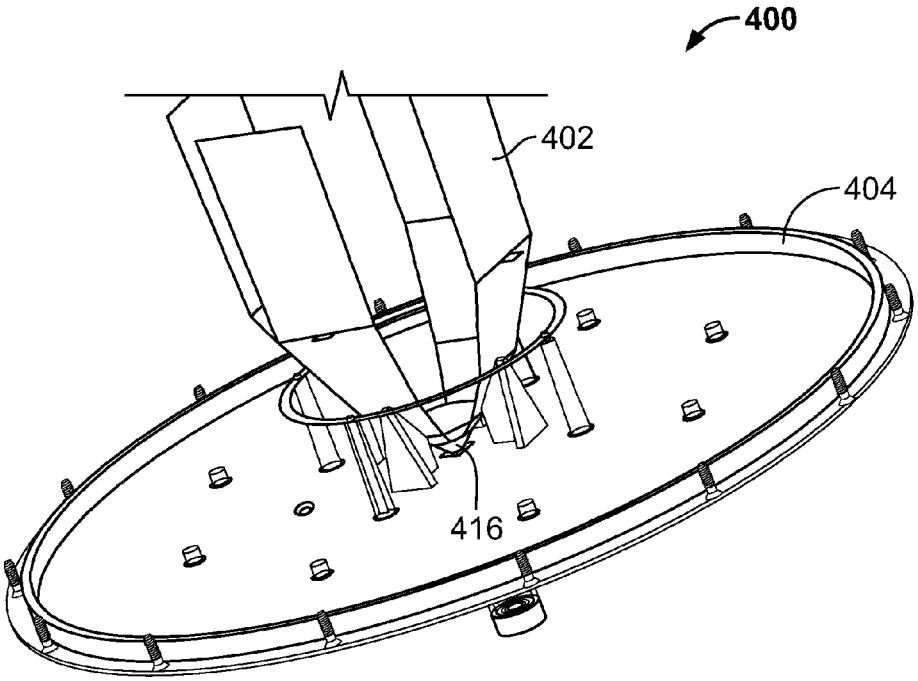
Figure 22:
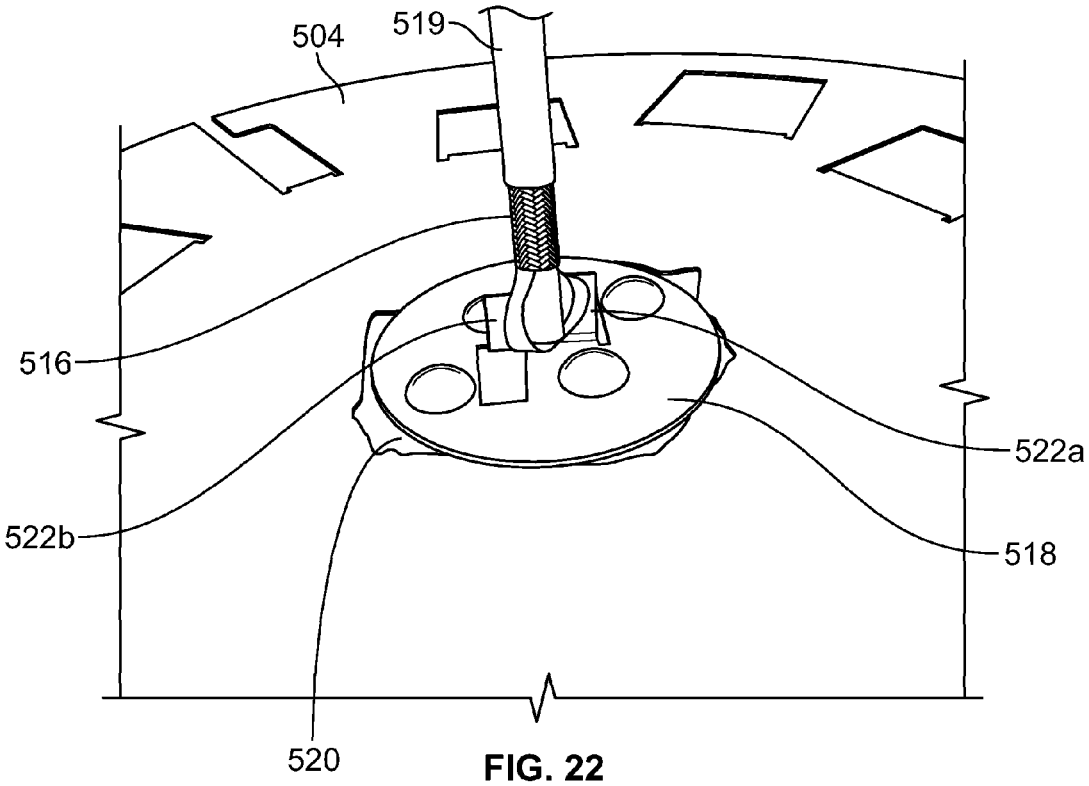
Figure 23:
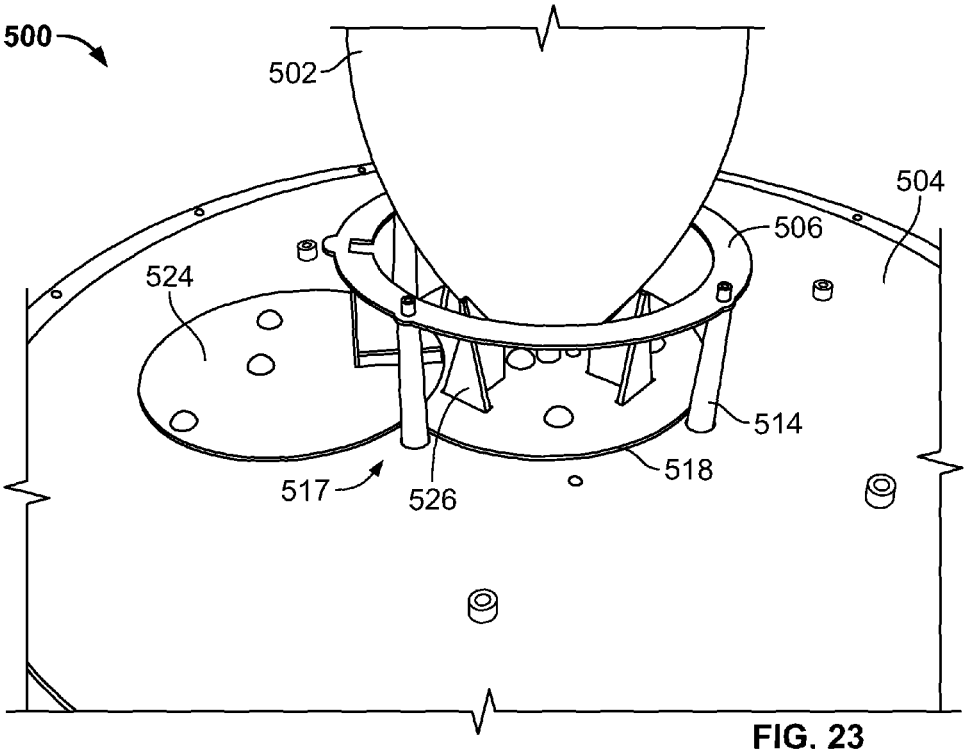
Figure 24:
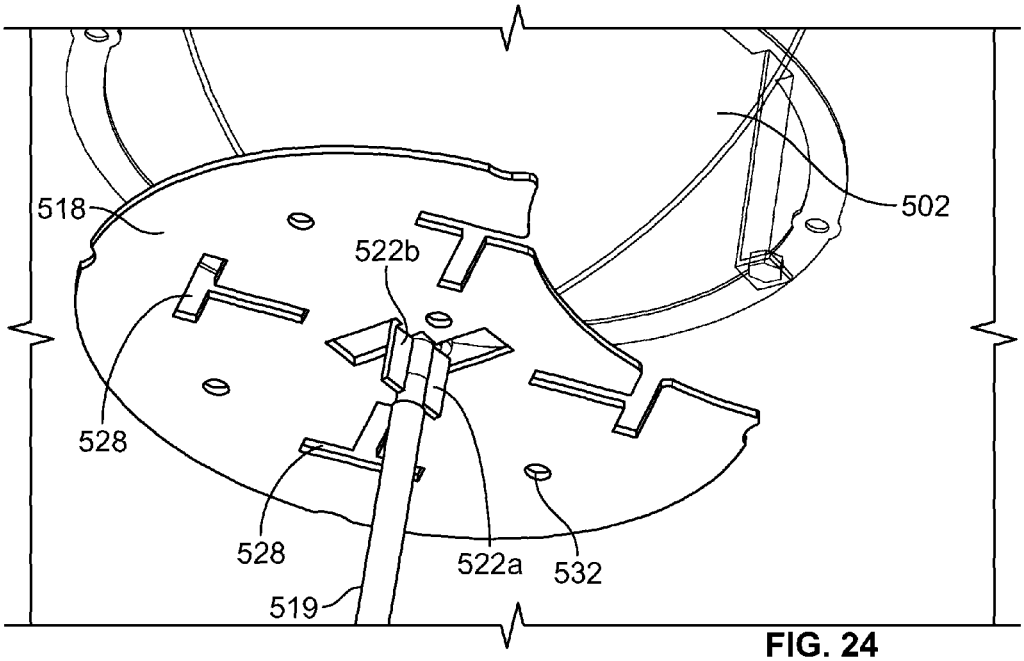
Figure 25:
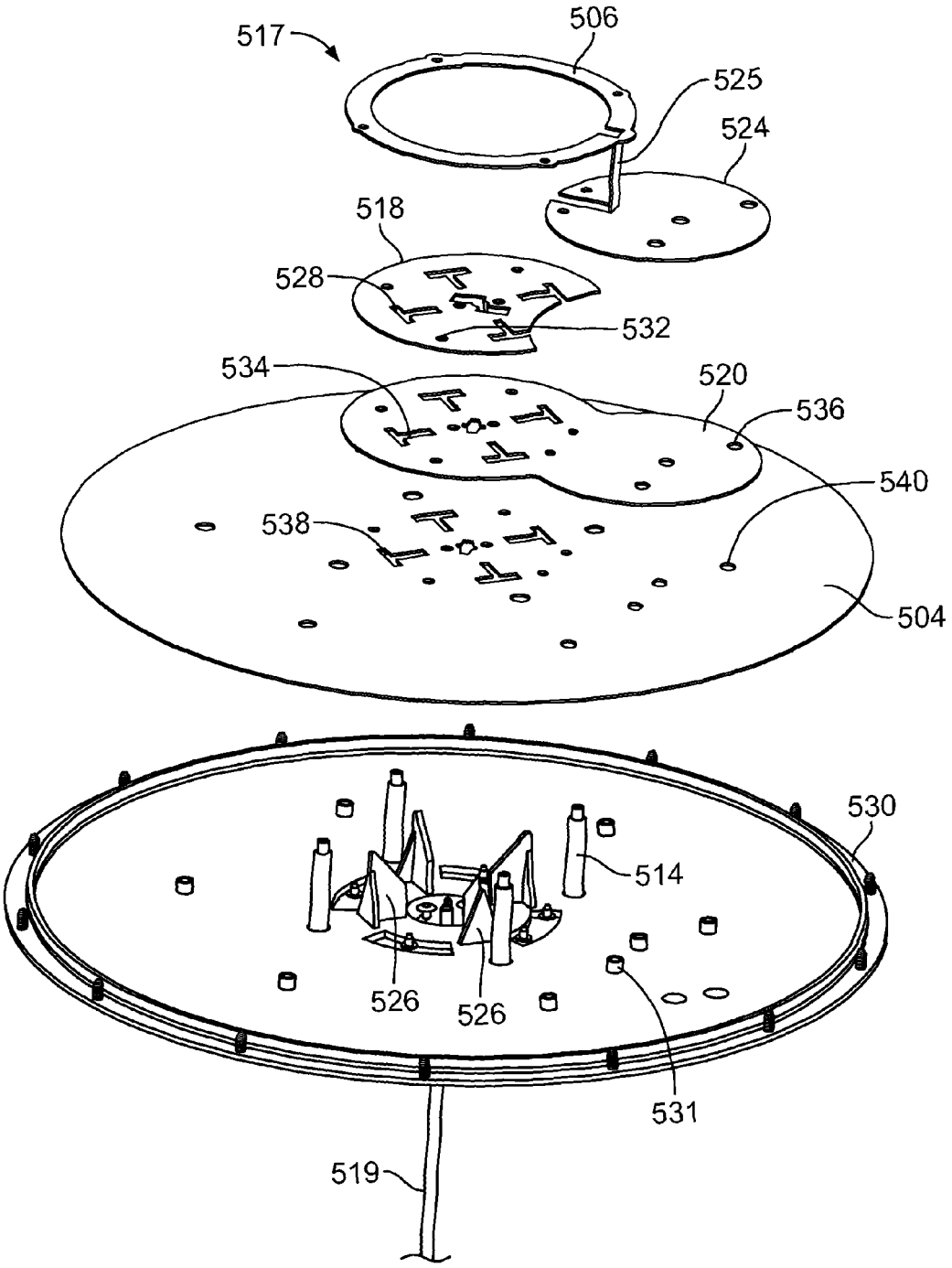
Figure 26:
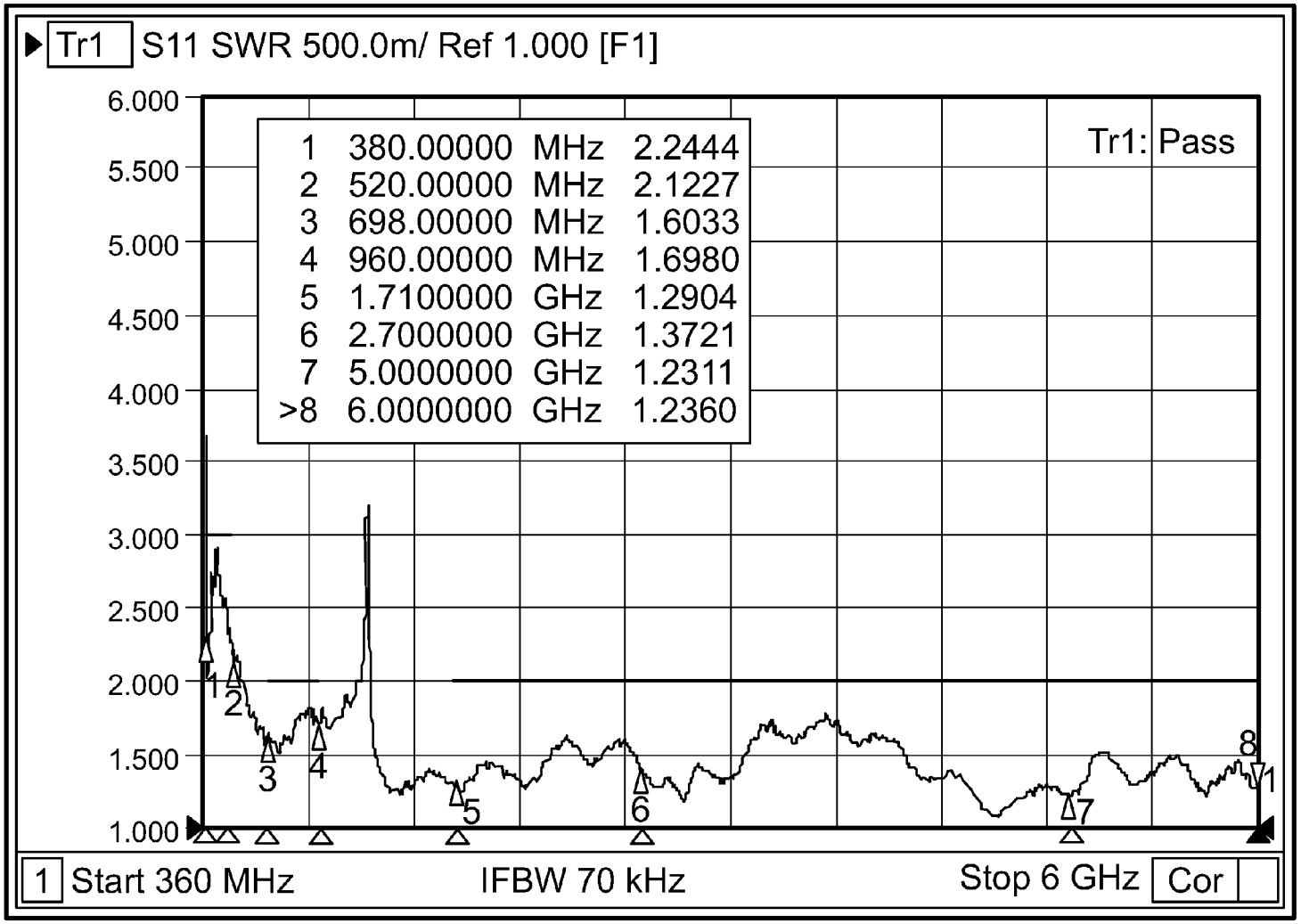
Figure 27:
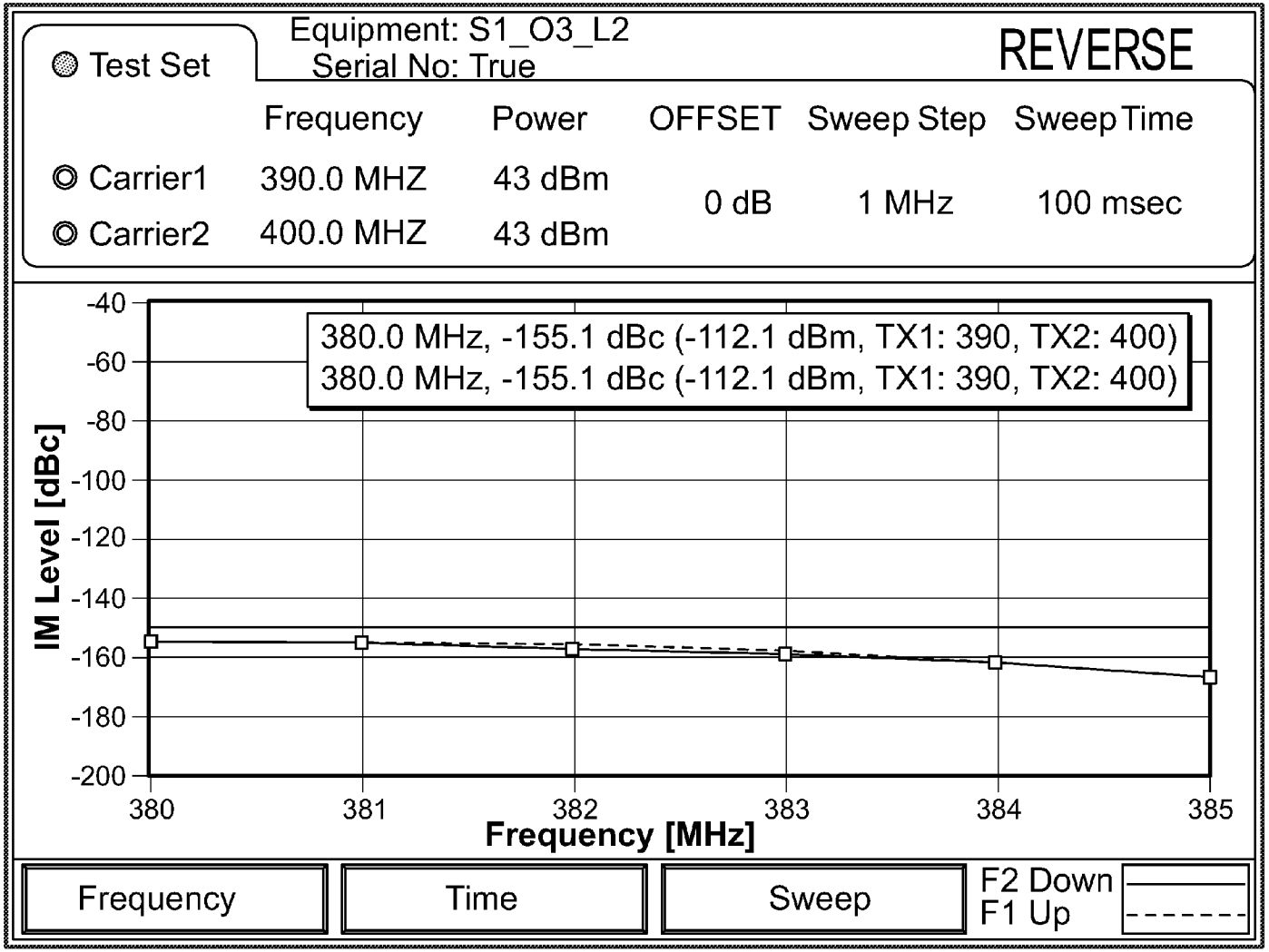
Figure 28:
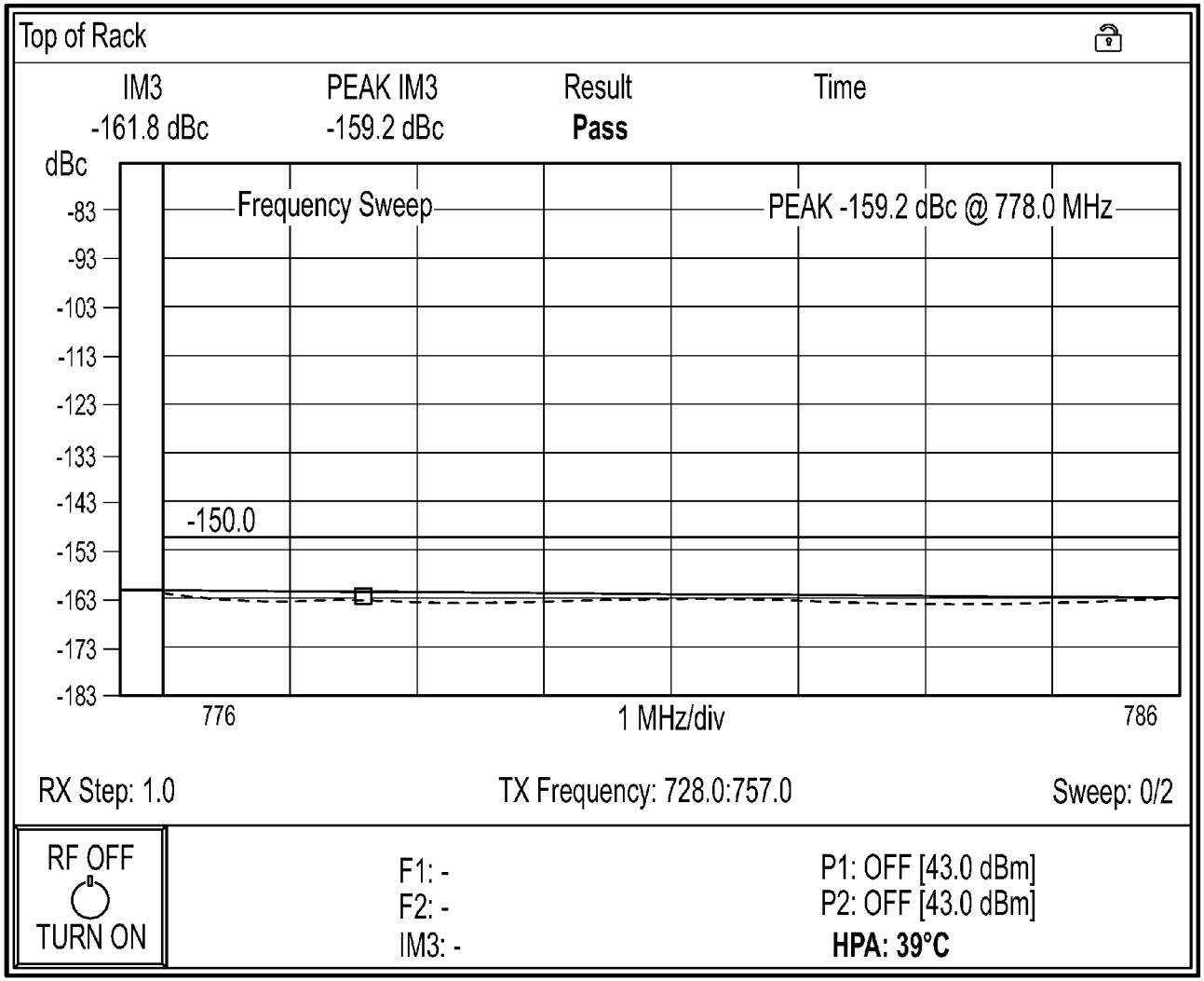
Figure 29:
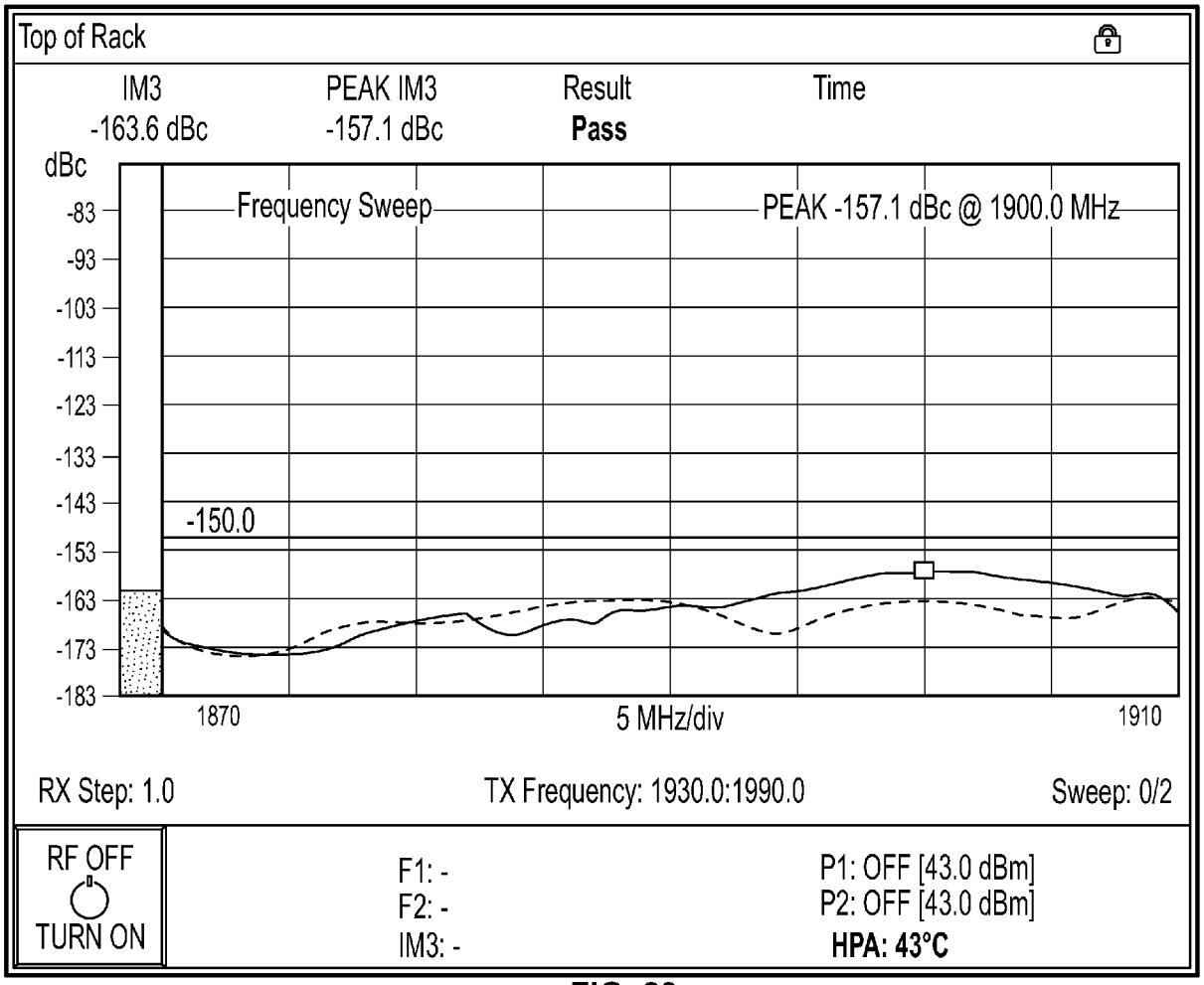
Figure 30:
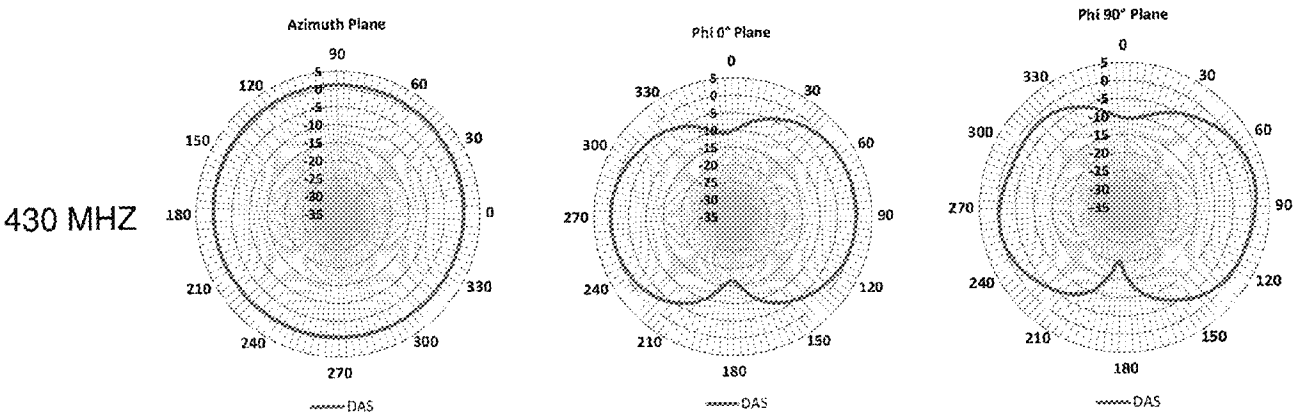
Figure 31:
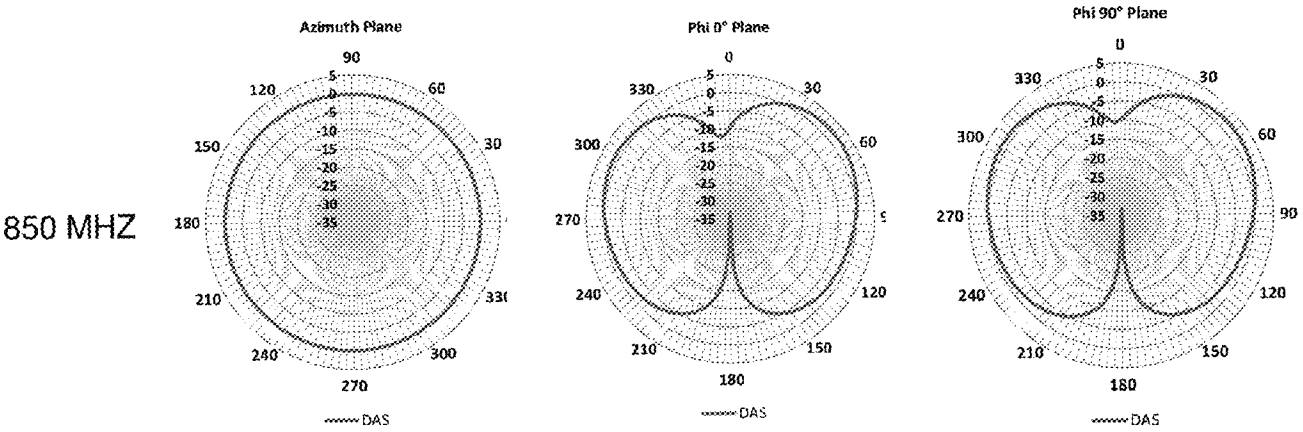
Figure 32:
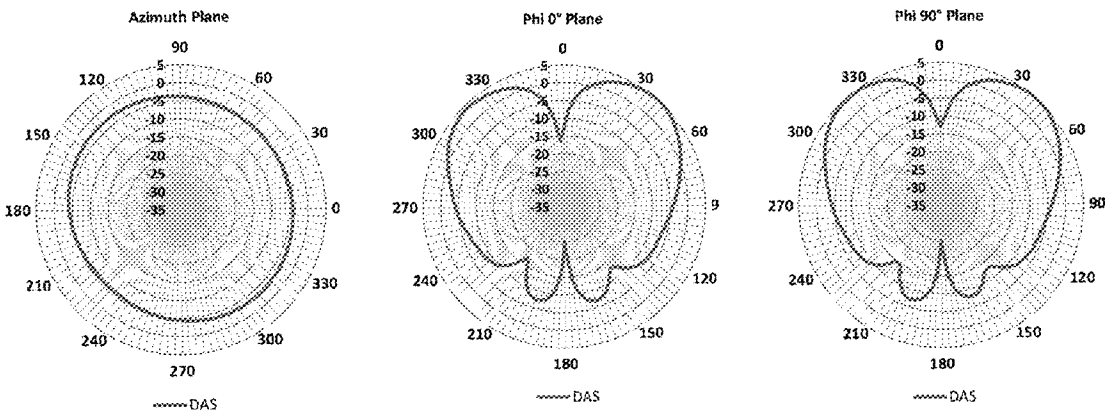
Figure 33:
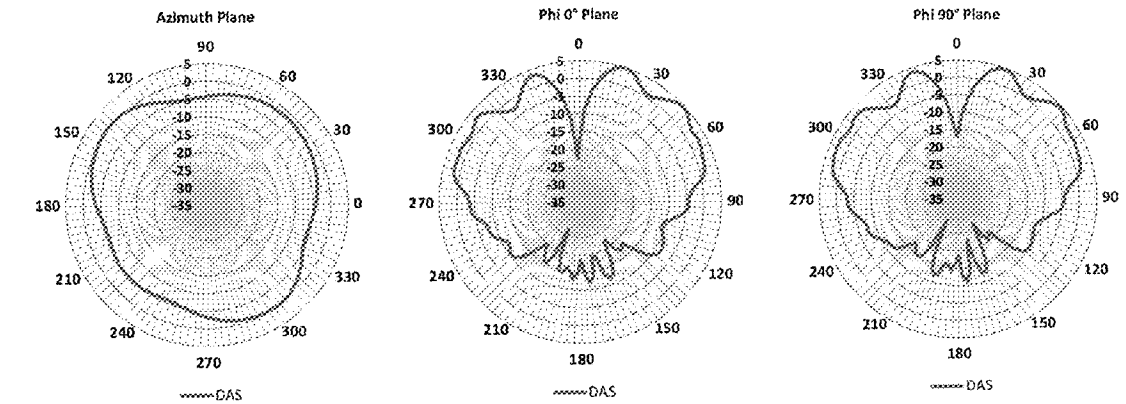

FIGS. 9A and 9B include computer simulation models showing surface currents at 380 MHz for the antenna element and ground plate shown in FIG. 1 without a parasitic ring element (FIG. 9A) and with a parasitic ring element (FIG. 9B);

FIGS. 10A and 10B are exemplary line graphs of voltage standing wave ratio (VSWR) versus frequency for computer simulation models of the exemplary antenna shown in FIG. 1 with the parasitic ring element and also without the parasitic ring element for comparison purposes;

FIGS. 11A through 11F illustrate radiation patterns for a computer simulation model of the exemplary antenna shown in FIG. 1 at frequencies of about 450 MHz, 710 MHz, 850 MHz, 1910 MHz, 2500 MHz, and 5500 MHz, respectively;

FIG. 12A illustrates radiation patterns for Elevation Plane Phi=90° for a computer simulation model of the exemplary antenna shown in FIG. 1 at frequencies of about 410 MHz, 710 MHZ, 850 MHz, 1910 MHz, 2500 MHz, and 5500 MHz;

FIG. 12B illustrates radiation patterns for Elevation Plane Phi=90° for a computer simulation model of the exemplary antenna shown in FIG. 1 at frequencies of about 410 MHz, 710 MHz, 850 MHZ, 1910 MHz, 5500 MHz, and 2500 MHz;

FIG. 12C illustrates radiation patterns for Azimuth Plane Theta=60° for a computer simulation model of the exemplary antenna shown in FIG. 1 at frequencies of about 410 MHz, 710 MHz, 850 MHz, 1910 MHz, 2500 MHz, and 5500 MHz;

FIG. 13 is a perspective view of a prototype of an omnidirectional broadband antenna according to the exemplary embodiment of FIGS. 1 through 3, where a radome is not shown for clarity;

FIG. 14 illustrates the prototype antenna of FIG. 13 shown with a radome according to an exemplary embodiment;

FIG. 15 is a perspective view of a prototype of an omnidirectional broadband antenna according to an alternative exemplary embodiment, where a radome is not shown for clarity;

FIG. 16 is an exemplary line graph of voltage standing wave ratio (VSWR) versus frequency measured for the prototype antenna shown in FIG. 13 with the radome shown in FIG. 14;

FIG. 17 illustrates radiation patterns for Elevation Plane measured for the prototype antenna shown in FIG. 13 with the radome shown in FIG. 14 at frequencies of about 410 MHz, 710 MHz, 850 MHz, 1910 MHz, 2500 MHz, and 5500 MHz;

FIG. 18 includes perspective views of antenna elements having different shapes that may be used in omnidirectional broadband antennas according to exemplary embodiments;

FIG. 19 is a perspective view of an antenna having PEM RF connector for a cable assembly;

FIG. 20 is a perspective view of an omnidirectional broadband antenna having a cup shaped radiator non low PIM version according to an exemplary embodiment;

FIG. 21 is a perspective view of an omnidirectional broadband antenna having a stamped cup shaped radiator according to another exemplary embodiment;

FIG. 22 is a perspective view showing a coaxial cable and a cable bracket, where a cable braid of the coaxial cable is soldered to the cable bracket and a thin electrical insulator is used to separate and electrically insulate the cable bracket from the antenna ground plane according to an exemplary embodiment;

FIG. 23 is a perspective view showing a cable bracket and a capacitive grounding plane on the antenna ground plane according to an exemplary embodiment;

FIG. 24 shows a cable bracket soldered with a cable assembly;

FIG. 25 is an exploded perspective view of a ground assembly for an omnidirectional broadband antenna that includes a cable bracket and a capacitive grounding plane aligned for positioning on an antenna ground plane with an electrical insulator therebetween according to an exemplary embodiment;

FIG. 26 is an exemplary line graph of voltage standing wave ratio (VSWR) versus frequency measured for a prototype Low PIM UHF-6 GHz SISO (single input, single output) antenna having the ground assembly shown in FIG. 25;

FIGS. 27, 28, and 29 are exemplary line graphs of intermodulation level (IM) in decibels relative to carrier (dBc) versus frequency in megahertz (MHz) showing the respective UHF band, low band, and high band PIM performance measured for the prototype Low PIM UHF-6 GHz SISO antenna having the ground assembly shown in FIG. 25; and FIGS. 30 through 33 illustrate radiation patterns for Azimuth Plane (Theta=0°), Phi 0° plane (Phi=0°), and Phi 90° Plane (Phi=90°) measured for the prototype Low PIM UHF-6 GHz SISO antenna having the ground assembly shown in FIG. 25 at respective frequencies of 430 MHz (FIG. 30), 850 MHz (FIG. 31), 2100 MHz (FIG. 32), and 5000 MHz (FIG. 33).

Corresponding reference numerals indicate corresponding parts throughout the several views of the drawings.

DETAILED DESCRIPTION

Example embodiments will now be described more fully with reference to the accompanying drawings.

The inventors hereof have recognized a need for broadband omnidirectional antennas that have relatively low PIM (Passive Intermodulation) (e.g., able to qualify as a low PIM rated design, etc.) by utilizing a cable bracket (e.g., a capacitively grounded cable bracket, etc.), good or improved bandwidth (e.g., at UHF, etc.), and/or provide more VSWR margins at production. Accordingly, disclosed herein are exemplary embodiments of capacitively grounded cable brackets (e.g., 518 (FIGS. 23-25), etc.) for broadband omnidirectional antennas (e.g., 300 (FIG. 20), 400 (FIG. 21), 500 (FIG. 23), etc.) that have a low PIM rated design or configuration.

In exemplary embodiments, a low PIM design may be realized by utilizing an assembly designed with materials with detailed consideration to reduce the risk of PIM source, and/or having process steps not stressing the galvanic contact.

According to aspects of the present disclosure, exemplary embodiments may include one or more (or all) of the following features to realize or achieve low PIM level. In an exemplary embodiment, the antenna preferably does not include any ferromagnetic material or ferromagnetic components including right plating that could otherwise be a source of PIM. Instead, the radiating element and ground plane (e.g., antenna element 102 and ground plate 104 in FIGS. 1-3, etc.) may instead be made of brass, aluminum, or other suitable non-ferromagnetic material. The connectors and cable are preferably PIM rated components.

The radiating element grounding may be based on proximity coupled grounding by introducing dielectric adhesive tape (broadly, dielectric member) below the radiating elements to avoid direct galvanic contact between the radiating elements and the ground plane. For example, a dielectric adhesive tape may be aligned for positioning between the radome 110 and ground plate 104.

Conventionally, high compression contact is normally based on fastener method, such as threaded stud and nut or PEM® fasteners. But the inventors hereof have recognized that fasteners with small diameters may have insufficient torque strength to secure high compression contact and that PEM® fasteners on a thin ground plane for a cable assembly can be inconsistent, such that the grip on the ground plane hole is not sufficient. The impact may not be significant at a certain frequency, but the impact cannot be negligible when at a lower frequency especially UHF band from 380 MHz to 520 MHz. Accordingly, the inventors have disclosed herein exemplary embodiments that have improved or low PIM level with either the galvanic contact soldered or proximity coupling and not with very high compression contact if the high compression is not achievable by the size of the components for the assemblies. Further, the ground plane may include a cable bracket designed for soldering a cable assembly to provide stable low PIM performance, especially for the lower frequency band for which it tends to be more difficult to achieve a reasonable PIM level.

With reference now to the figures, FIG. 1 illustrates an example antenna 100 embodying one or more aspects of the present disclosure. As shown, the antenna 100 includes an antenna element 102 having an exponential tapered cone shape or form. The antenna 100 also includes a ground plate 104 (broadly, a ground element or member) and an electrically-conductive ring 106 (broadly, an annular or patch element). The electrically-conductive ring 106 is electrically coupled to the ground plate 104 and parasitically coupled to the antenna element 102.

The electrically-conductive ring 106 surrounds at least a portion of the antenna element 102. The antenna 100 also includes an antenna element holder 108 assembled onto the ground plate 104. The antenna element holder 108 holds at least a portion of the antenna element 102 to support and electrically isolate the antenna element 102 from the ground plate 104 while holding the antenna element 102 in place. The antenna element holder 108 may comprise plastic or other suitable dielectric material.

The antenna 100 may be a compact, ultra-broadband, in-building antenna, and may be used for applications such as a distributed antenna system. For example, the antenna 100 may be used indoors and may be mounted to a ceiling in some embodiments. The antenna 100 may be vertically polarized, and may operate at a frequency range between about 380 MHz to about 5000 MHz. The antenna 100 may support public safety frequency (TETRA).

The entire antenna element 102 is illustrated as having a conical, exponentially tapered form or shape. The illustrated antenna element 102 may comprise a cone have outwardly curved or convex sides in which the separation of the sides increases as an exponential function of length. The tapered cone form of the antenna element 102 may be shaped to improve bandwidth of the antenna 100. The tapered cone form may be optimized to create an optimized bandwidth in some embodiments. Although one example tapered cone form is illustrated in FIG. 1, other embodiments may include an antenna element having other forms or shapes (e.g., other exponential tapered shapes or conical forms, cones approaching the exponential taper, regular cone shaped, etc.). For example, FIG. 18 illustrates antenna elements 602, 702, and 802 having different shapes that may be used in omnidirectional broadband antennas according to exemplary embodiments. For an additional example, FIG. 21 illustrates another possible shape by stamping parts.

The antenna element 102 may comprise any suitable non-ferromagnetic material for radiating a signal at an operating frequency with low PIM, such as, for example, an electrically-conductive brass, electrically-conductive alloy, electrically-conductive non-metal, electrically-conductive composite, brass, metalized plastic, printed electrically-conductive ink on a dielectric or non-conductive substrate, etc. The antenna element 102 may instead comprise ferromagnetic material with a very thick non-ferromagnetic plating.

The ground plate 104 is illustrated as a flat, circular plate, located perpendicular to a center axis of the antenna element 102. Alternative embodiments may include other suitable ground members or ground planes besides the ground plate 104, such as a ground member having a non-circular shape (e.g., rectangular, octagonal, etc.) and/or that is not flat or plate like, etc.

In this exemplary embodiment, the center axis of the antenna element 102 is aligned with the center of the ground plate 104. The ground plate 104 is spaced apart from the antenna element 102 such that no electrically-conductive portion of the antenna element 102 is in contact with an electrically-conductive portion of the ground plate 104. The ground plate 104 may form a ground plane for the antenna 100. The ground plate 104 may comprise any suitable material for electrically grounding any connected components or received signals, such as, for example, an electrically-conductive brass, electrically-conductive alloy, electrically-conductive non-metal, electrically-conductive composite, aluminum, metalized plastic, printed electrically-conductive ink on a dielectric or non-conductive substrate, printed circuit board, etc. The ground plate 104 preferably comprises non-ferromagnetic material for low PIM performance.

The electrically-conductive ring 106 surrounds at least a portion of the antenna element 102 and parasitically or capacitively couples to the antenna element 102. The electrically-conductive ring 106 is electrically connected and grounded to the ground plate 104 via a grounding pin 112. Accordingly, the electrically-conductive ring 106 may also be referred to as a grounded parasitic patch ring element.

The electrically-conductive ring 106 is arranged horizontally over the ground plate 104. In some embodiments, the electrically-conductive ring 106 may act as a $\lambda/4$ wave trap for about a 400 MHz band operating frequency, which may make the bandwidth of the 400 MHz band wider. In some embodiments, the conductive ring diameter and location may be adjusted to improve the voltage standing wave ratio (VSWR) of the range of operating frequencies between about 380 MHz and about 520 MHz. The electrically-conductive ring 106 may comprise any suitable material, such as, for example, an electrically-conductive metal, electrically-conductive alloy, electrically-conductive non-metal, electrically-conductive composite, brass, metalized plastic, printed electrically-conductive ink on a dielectric or non-conductive substrate, printed circuit board, etc.

In this exemplary embodiment, the electrically-conductive ring 106 is circular and positioned parallel to the ground plate 104. But the ring 106 is not limited to circular shapes, as other suitable shapes may also be used for the ring 106 including shapes such as a rectangle, square, pentagon, hexagon, oval, triangle, etc. The center of the electrically-conductive ring 106 is aligned with the center axis of the antenna element 102, and is also aligned with the center of the ground plate 104. The electrically-conductive ring 106 may be concentric with the antenna element 102 and ground plate 104. The electrically-conductive ring 106 is positioned to surround at least a portion of the antenna element 102, but is spaced from the antenna element 102 such that no electrically-conductive portion of the antenna element 102 is in contact with the electrically-conductive ring 106.

The electrically-conductive ring 106 radiates a vertically polarized wave omnidirectionally in the azimuth plane in the 380-520 MHz band. The directional gain is substantial in the azimuth plane, while the ripple of the radiation pattern is very low in the same plane. The utility of the electrically-conductive ring 106 is that it radiates an omnidirectional wave at the very low frequency band 380-520 MHz, while not disturbing the omnidirectional radiation pattern emanating from radiating antenna element 102 at 700-6000 MHz frequencies. The presence of the electrically-conductive ring 106 makes the whole antenna 100 electrically small for the lower frequency band 380-520 MHz. Thus, the antenna 100 is compact and desirable for its size to customers. The symmetrical electrically-conductive ring 106 around the antenna element 102 makes the electrical fields uniform and of about equal strength for all angles in the azimuth plane in the whole operating band 380-600 MHz. Therefore, the radiating performance of the antenna 100 is superior to previous commercial antenna products.

The antenna element holder 108 is shaped to hold the antenna element 102 in place. The antenna element holder 108 acts as an isolator between the antenna element 102 and the ground plate 104. Accordingly, the antenna element holder 108 helps to prevent the antenna element 102 from making direct galvanic contact with the ground plate 104.

The antenna element holder 108 may be mechanically fastened to the ground plate 104 using any suitable means, such as, for example, a plurality of screws. The antenna element holder 108 may be positioned to contact the antenna element 102 to keep the antenna element 102 in a substantially perpendicular position relative to the ground plate 104.

The antenna element holder 108 is illustrated as merely holding the antenna element 102 and not mechanically fastened to the antenna element 102 with any fasteners or connectors. But other embodiments may include an antenna holder that is directly connected (e.g., mechanically fastened, etc.) to the antenna element 102. In some embodiments, the antenna element holder 108 may only provide support for the antenna element 102, and other structures and/or connections may be necessary to prevent any movement of the antenna element 102 in any direction. The antenna element holder 108 may comprise any material suitable for electrically isolating the antenna element 102 and ground plate 104 and providing support to the antenna element 102, such as, for example, plastic, a composite material, a dielectric material, etc. In an exemplary embodiment, the antenna element holder 108 may be molded together with a plastic spacer 114, for example, for easier assembly and cost savings.

In some embodiments, the antenna 100 may include a radome, cover, or radome 110. The radome 110 may be configured to cover other components of the antenna 100, to protect them from external elements, or hide them from user view. The radome 110 may be assembled to the ground plate 104 using any suitable fasteners, such as, for example, a plurality of screws. The radome 110 may comprise any material (e.g., plastic, etc.) suitable for allowing radiated signals to pass through the radome 110. In some embodiments, the radome 110 may be shaped to cover the other antenna components with a minimal profile. In the embodiment illustrated in FIG. 1, the radome 110 includes a closed, circular end cap portion having a diameter slightly larger than the diameter of the antenna element 102, and an open, circular base portion having a diameter substantially similar to the diameter of the ground plate 104.

The antenna 100 may also include a grounding pin 112 connected between the electrically-conductive ring 106 and the ground plate 104. The grounding pin 112 may be metallized to act as an electrically-conductive connection from the electrically-conductive ring 106 to the ground plate 104. The grounding pin 112 may be configured to also provide support for the electrically-conductive ring 106 to position the electrically-conductive ring 106 parallel to the ground plate 104. The grounding pin 112 may comprise any suitable material, such as, for example, an electrically-conductive metal, electrically-conductive alloy, electrically-conductive non-metal, electrically-conductive composite, brass, metalized plastic, printed electrically-conductive ink on a dielectric or non-conductive substrate, etc.

The antenna 100 may also include a plurality of support pins 114 connected between the electrically-conductive ring 106 and the ground plate 104. The support pins 114 may be configured to support the electrically-conductive ring 106 such that the electrically-conductive ring 106 is spaced apart from and generally parallel to the ground plate 104. The support pins 114 may comprise any material suitable for supporting the electrically-conductive ring 106, such as, for example, plastic, other dielectric materials, etc. Although FIG. 1 illustrates one grounding pin 112 and three support pins 114, other embodiments may include more than one grounding pin, and more or less than three support pins. The electrically-conductive grounding pin 112 and support pins 114 may be perpendicular to the ground plate 104.

The antenna 100 may also include a coaxial plug element 116 (broadly, a connector) having an inner conductor and an outer conductor. A recess, opening, or hole may be located at about the center of the ground plate 104. The coaxial plug element 116 may be positioned and attached (e.g., mechanically fastened, etc.) underneath the opening. The outer conductor of the coaxial plug element 116 may be electrically conductively connected to the ground plate 104. The inner conductor of the coaxial plug element 116 may pass through the opening and be electrically conductively connected to the antenna element 102. For example, the inner conductor of the coaxial plug element 116 may be soldered to the apex or end of the cone shape of the antenna element 102. The coaxial plug element 116 may be configured to connect the antenna 100 to other systems so that the antenna 100 is capable of sending and/or receiving signals using the antenna element 102 and the coaxial plug element 116.

FIG. 2 is a perspective view of the exemplary antenna 100 shown in FIG. 1. The antenna 100 is illustrated showing an antenna element 102, a ground plate 104, an electrically-conductive ring 106, an antenna element holder 108, an electrically-conductive grounding pin 112, and support pins 114.

FIG. 3 is a side view of the exemplary antenna 100 shown in FIG. 1. The antenna 100 is illustrated showing an antenna element 102, a ground plate 104, an electrically-conductive ring 106, an antenna element holder 108, an electrically-conductive grounding pin 112, support pins 114, and a coaxial plug element 116.

Figure 4:
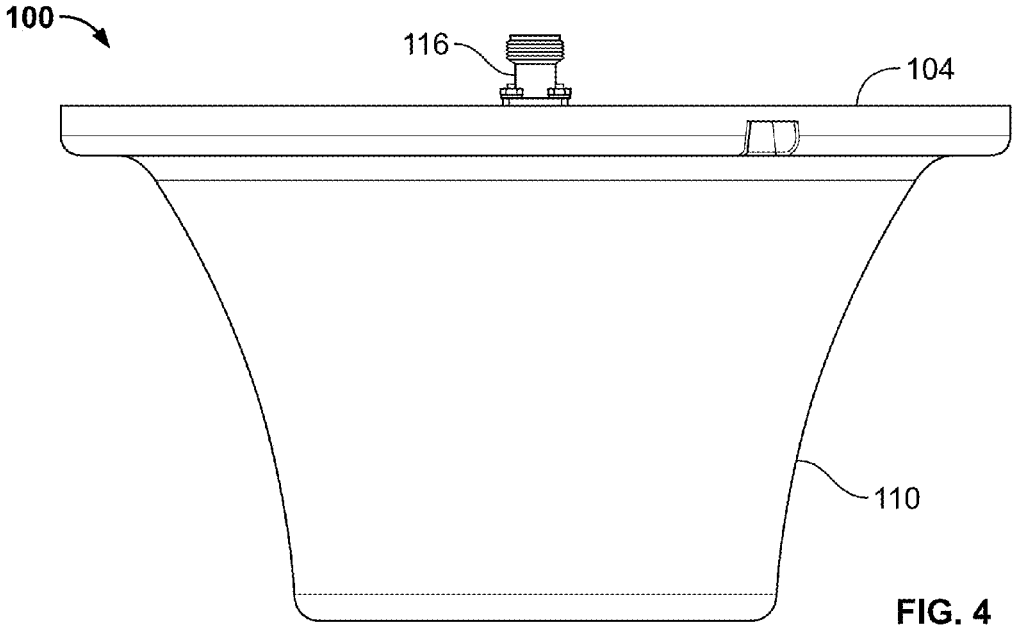
FIG. 4 is a side view of the exemplary antenna of FIG. 2 shown with the radome.

FIG. 4 is another side view of the exemplary antenna 100 shown in FIG. 1. The antenna 100 is illustrated with a radome 110 having an end cap portion and a base portion. The radome 110 covers other antenna components inside the radome 110, such as an antenna element. The end cap portion has a diameter slightly larger than the diameter of the antenna element 102, and the base portion has a diameter substantially similar to the diameter of the ground plate 104. The antenna 100 also includes a coaxial plug element 116. The antenna 100 may have a vertical orientation as illustrated in FIG. 2 when the antenna is mounted to an indoor ceiling.

Figure 5:
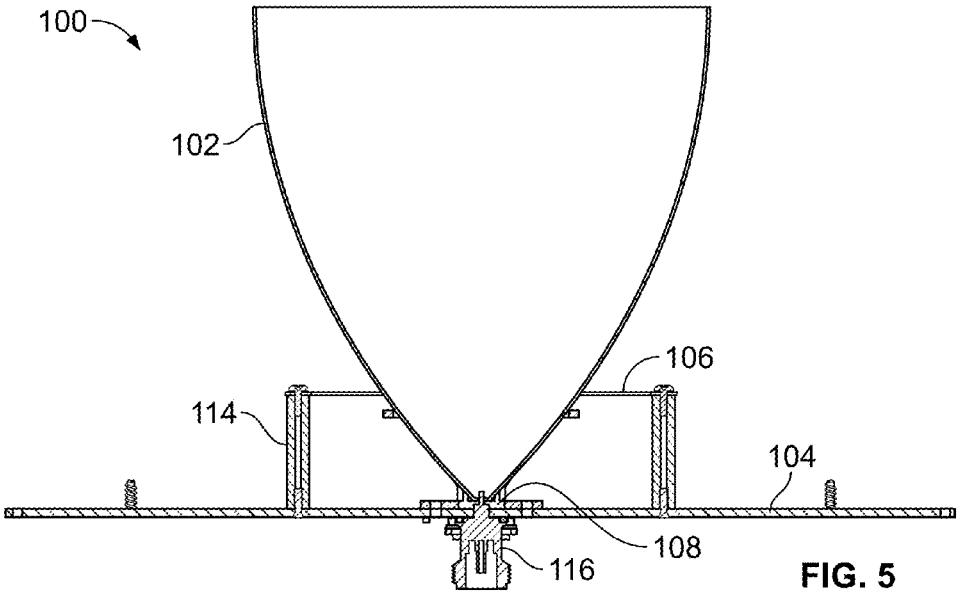
FIG. 5 is a vertical cross-sectional view of the exemplary antenna shown in FIG. 3.

FIG. 5 is a side cross-sectional view of the exemplary antenna 100 shown in FIG. 1. The antenna 100 is illustrated showing an antenna element 102, a ground plate 104, an electrically-conductive ring 106, an antenna element holder 108, support pins 114, and a coaxial plug element 116. The cross section has been taken perpendicular to the ground plate 104 and the antenna element 102, and passes through the center axis of the antenna element 102 and the center of the ground plate 104.

Figure 6:
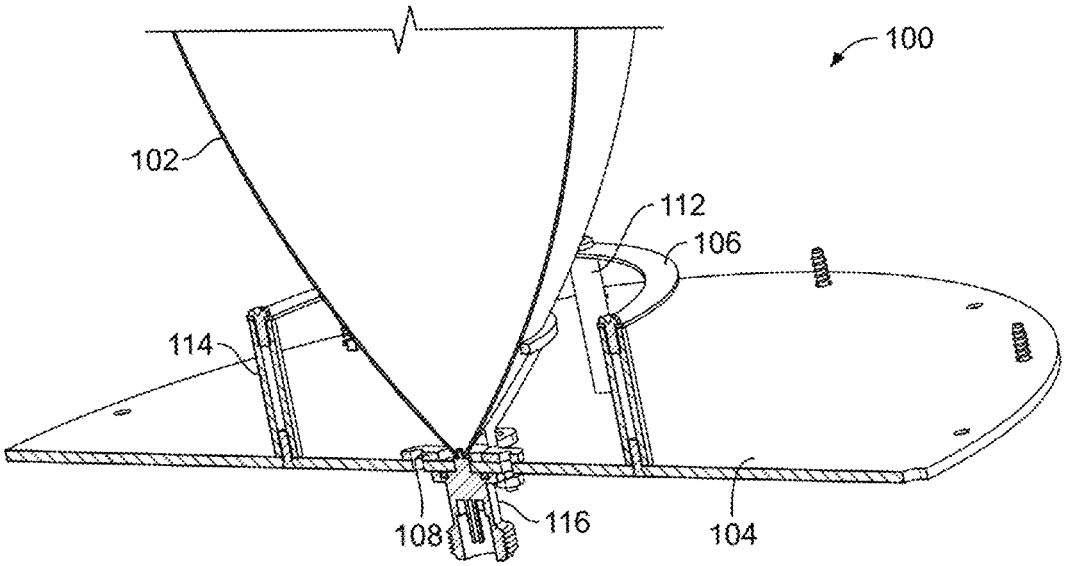
FIG. 6 is a perspective cross-sectional view of the exemplary antenna shown in FIG. 2.

FIG. 6 is a perspective cross-sectional view of the exemplary antenna 100 shown in FIG. 1. The antenna 100 is illustrated showing an antenna element 102, a ground plate 104, an electrically-conductive ring 106, an antenna element holder 108, electrically-conductive grounding pin 112, support pins 114, and a coaxial plug element 116. The cross section has been taken perpendicular to the ground plate 104 and the antenna element 102, and passes through the center axis of the antenna element 102 and the center of the ground plate 104.

Figure 7:
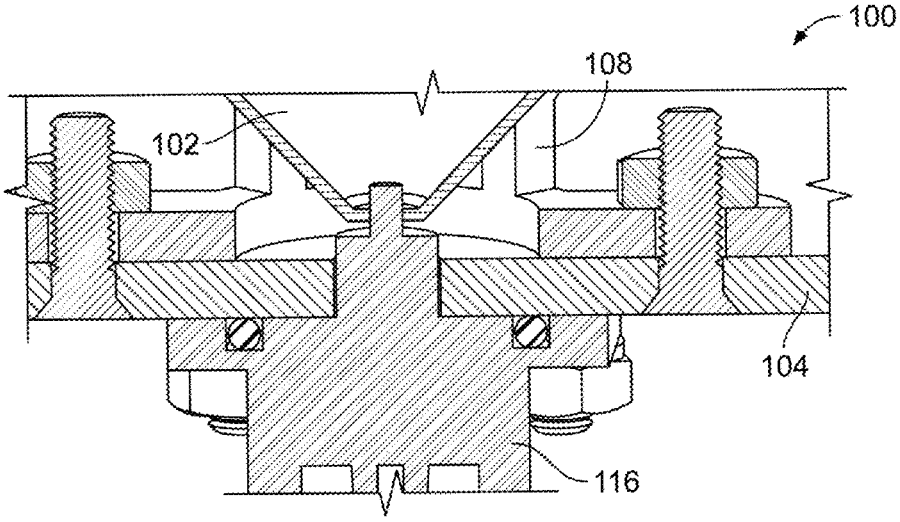
FIG. 7 is a vertical cross-sectional view of the cable mount interface of the exemplary antenna shown in FIG. 1.

FIG. 7 is a vertical cross-sectional view of a cable mount interface of the exemplary antenna 100 shown in FIG. 1. The antenna 100 is illustrated showing an antenna element 102, a ground plate 104, an antenna element holder 108, and a coaxial plug element 116. The ground plate 104 includes an opening, hole or recess. The coaxial plug element 116 is positioned and attached in and underneath the opening. The outer conductor of the coaxial plug element 116 is electrically conductively connected to the ground plate 104. The inner conductor of the coaxial plug element 116 is passed through the opening and connected to the antenna element 102.

Figure 8:
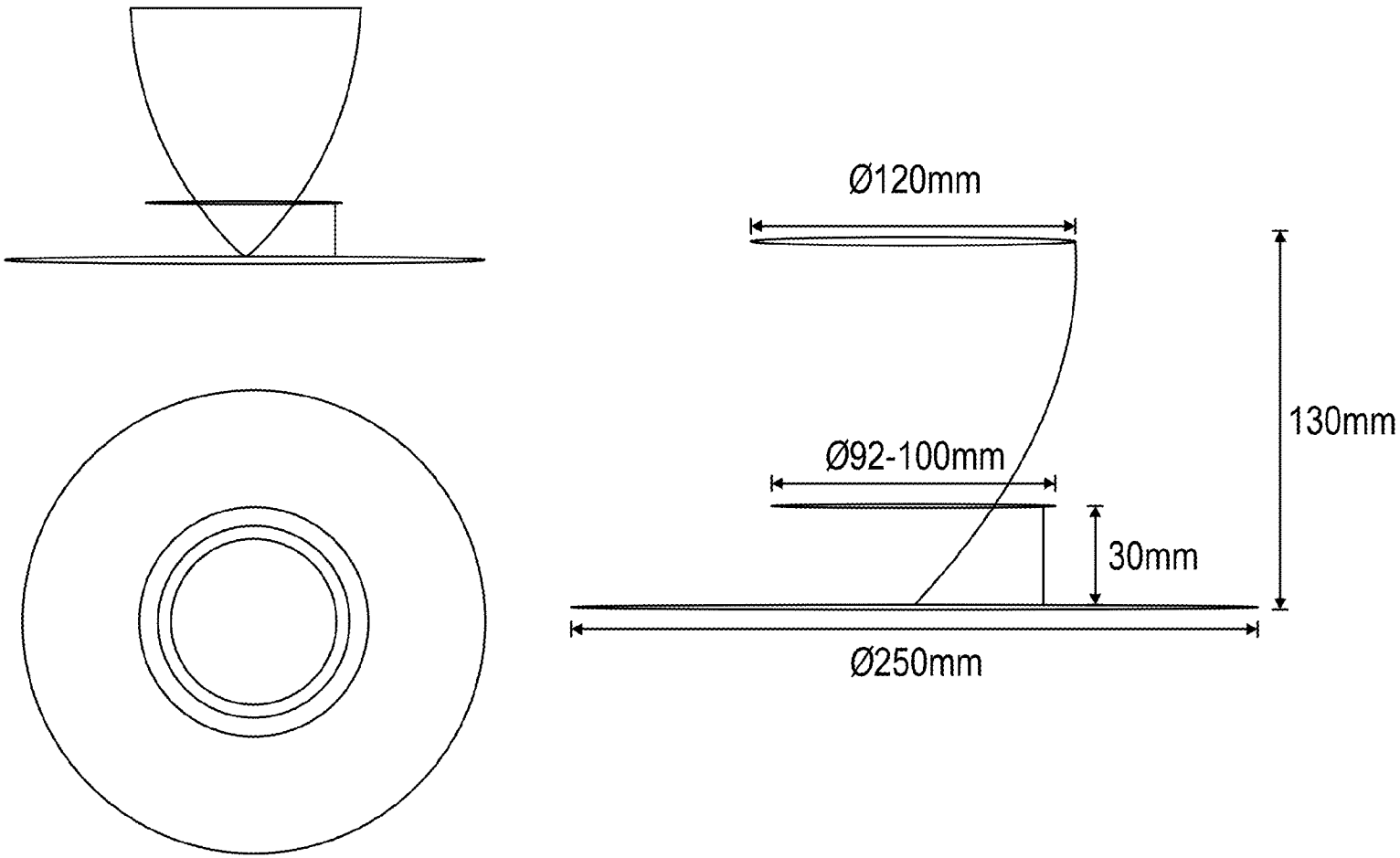
FIG. 8 illustrates the antenna element of the antenna shown in FIG. 1, where the exemplary dimensions are provided for purposes of illustration only according to exemplary embodiments.

FIG. 8 is a view of the exemplary antenna shown in FIG. 1 with exemplary dimensions. The antenna element opening has a diameter of about 120 mm, and the antenna element has a height of about 130 mm. The electrically-conductive ring has a diameter in a range between about 92 mm and about 100 mm, and a width of about 6 mm. In this embodiment, the electrically-conductive ring is separated from the ground plate by about 30 mm. In other embodiments, the electrically-conductive ring may be separated from the ground plate by other distances, such as, for example, about 50 mm. The ground plate has a diameter of about 250 mm. Although the radome is not illustrated in FIG. 8 the radome may have a base portion diameter of about 250 mm, an end cap diameter of about 132 mm, and a height of about 140 mm. Although FIG. 8 illustrates dimensions for several of the antenna components according to one example embodiment, it is understood that other dimensions may be used in other embodiments without departing from the scope of the present disclosure.

FIGS. 9A and 9B include computer simulation models generated in CST Microwave Studio® 3D EM simulation software. More specifically, FIGS. 9A and 9B show surface currents for the antenna element 102 and ground plate 104 shown in FIG. 1 without any electrically-conductive ring (FIG. 9A) and with the electrically-conductive ring (FIG. 9B). The electrically-conductive ring 106 may be a parasitic patch element, acting as a $\lambda/4$ wave trap for a 400 MHz band operating frequency. A resonant mode can be excited and operated close to 400 MHz, which can make the bandwidth of the 400 MHz band wider. The patch ring diameter and location can be adjusted to achieve a VSWR of less than 3.0 to one for the 380 MHz to 520 MHz band. In this example, the electrically-conductive ring had a radius of 50 mm and a width of 6 mm, and was located a height of 30 mm over the ground plate or plane. Alternative embodiments may include a differently configured grounded patch parasitic element than the electrically-conductive ring, e.g., larger, smaller, non-circular, different location, etc.

FIGS. 10A and 10B are exemplary line graphs of voltage standing wave ratio (VSWR) versus frequency for computer simulation models of the exemplary antenna with the parasitic ring element and also without the parasitic ring element for comparison purposes. More specifically, FIG. 10A is an exemplary line graph of the VSWR versus frequency from 200 MHz to 6 GHz for the antenna with and without the electrically-conductive ring. FIG. 10B is an exemplary line graph of the VSWR versus frequency from about 325 MHz to about 1.57 GHz for the antenna with and without the electrically-conductive ring. The VSWR line graphs generally demonstrate that the performance of the antenna with the electrically-conductive ring is superior to the performance of the antenna without the electrically-conductive ring, especially at a frequency of about 380 MHz. Extra resonance is created around about 380 MHz, and the VSWR is improved from about 4.35 to less than 2.5. For example, FIGS. 10A and 10B shows that the antenna with and without the electrically-conductive ring had a VSWR of about 1.213 and 4.358, respectively, at a frequency of 380 MHz. FIG. 10B shows that the antenna with the electrically-conductive ring had a VSWR of about 2.315 at a frequency of 520 MHz, a VSWR of about 1.897 at a frequency of 698 MHz, and a VSWR of about 1.374 at a frequency of 960 MHz.

Figure 11A:
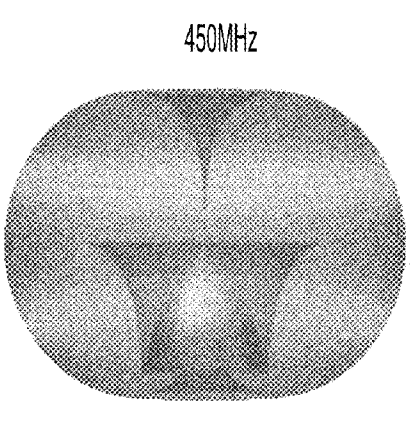
Figure 11B:
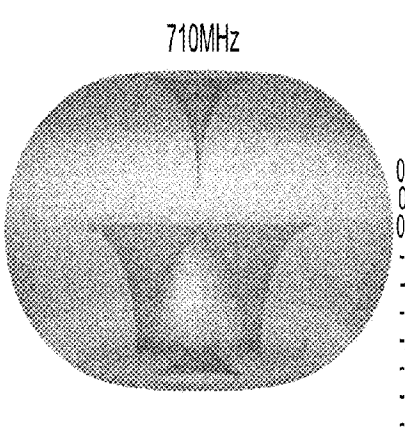
Figure 11C:
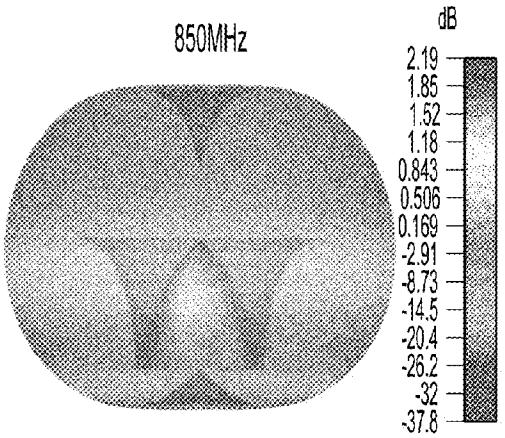
Figure 11D:
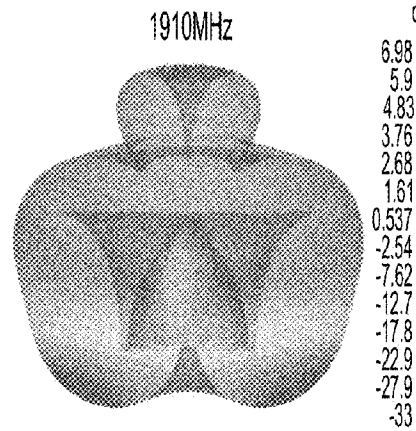
Figure 11E:
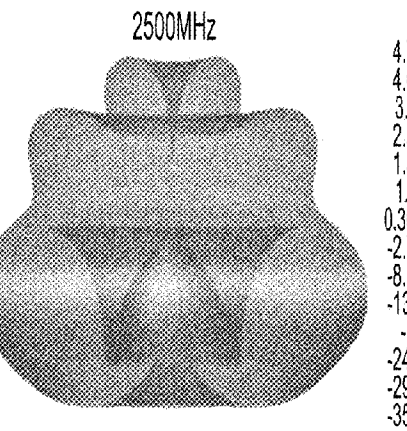
Figure 11F:
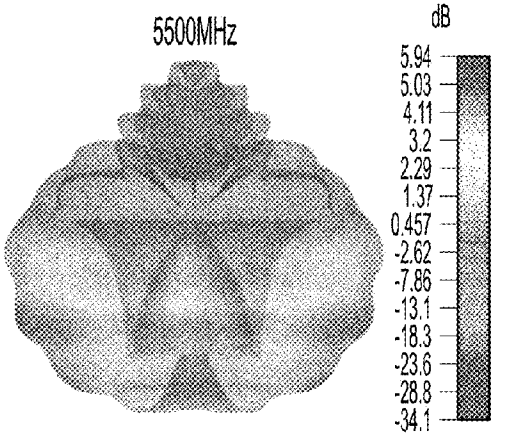

FIGS. 11A through 11F illustrate radiation patterns for a computer simulation model of the exemplary antenna. More specifically, FIG. 11A illustrates a radiation pattern of the antenna at an operating frequency of 450 MHz. FIG. 11B illustrates a radiation pattern of the antenna at an operating frequency of 710 MHz. FIG. 11C illustrates a radiation pattern of the antenna at an operating frequency of 850 MHz. FIG. 11D illustrates a radiation pattern of the antenna at an operating frequency of 1910 MHz. FIG. 11E illustrates a radiation pattern of the antenna at an operating frequency of 2500 MHz. FIG. 11F illustrates a radiation pattern of the antenna at an operating frequency of 5500 MHz. Generally, FIGS. 11A through 11F show that the antenna has good omnidirectional radiation patterns for frequencies from about 380 MHz to about 6 GHz.

FIGS. 12A through 12C illustrate two-dimensional radiation patterns for a computer simulation model of the exemplary antenna at typical frequencies of operation. More specifically, FIG. 12A shows far-field gain abs for Elevation Plane Phi=90° at frequencies of about 410 MHz, 710 MHz, 850 MHz, 1910 MHz, 2500 MHz, and 5500 MHz. FIG. 12B shows far-field gain (1D results) for Elevation Plane Phi=0° at frequencies of about 410 MHz, 710 MHz, 850 MHz, 1910 MHz, 2500 MHz, and 5500 MHz. FIG. 12C shows far-field gain abs for Azimuth Plane Theta=60° at frequencies of about 410 MHz, 710 MHz, 850 MHz, 1910 MHz, 2500 MHz, and 5500 MHz.

In this exemplary embodiment, the exemplary antenna 100 had a VSWR of less than or equal to about three to one (3:1) when operating in a frequency range between about 380 MHz and 520 MHz, a VSWR of less than or equal to about two to one (2:1) when operating in a frequency range between about 698 MHz and 960 MHz, and a VSWR of less than or equal to about 1.8 to one (1.8:1) when operating in a frequency range between about 1710 MHz and about 6000 MHz. Although the exemplary antenna 100 of FIG. 1 has the above VSWR values at specified operating frequencies, it is understood that other embodiments may have different VSWR values for various ranges of operating frequencies.

The exemplary antenna 100 has a gain of about 2 decibels isotropic (dBi) when operating in a frequency range between about 380 MHz and 520 MHz, a gain of about 3 dBi when operating in a frequency range between about 698 MHz and 960 MHz, a gain of about 7 dBi when operating in a frequency range between about 1710 MHz and about 4300 MHz, and a gain of about 6 dBi when operating in a frequency range between about 4300 MHz and about 6000 MHz. Although the exemplary antenna 100 of FIG. 1 has the above gain values at specified operating frequencies, it is understood that other embodiments may have different gain values for other ranges of operating frequencies.

FIG. 13 is a perspective view of a prototype of an omnidirectional broadband antenna according to the exemplary embodiment of FIGS. 1 through 3, where the radome is not shown for clarity. FIG. 14 illustrates the prototype antenna of FIG. 13 shown with a radome according to an exemplary embodiment. In this example, the prototype antenna had a compact form with a ground plate diameter of 250 mm, a height of 134 mm, and an end cap diameter of 120 mm.

FIG. 15 is a perspective view of a prototype of an omnidirectional broadband antenna according to an alternative exemplary embodiment, where the radome is not shown for clarity. In this example, the antenna element includes a first portion that is conical and a second portion that is cylindrical.

FIG. 16 is an exemplary line graph of voltage standing wave ratio (VSWR) versus frequency from 200 MHz to 6500 MHz measured for the prototype antenna shown in FIG. 13 with the radome shown in FIG. 14. The VSWR line graph generally demonstrates the excellent performance of the prototype antenna with the electrically-conductive ring. FIG. 16 also shows that the prototype antenna with the electrically-conductive ring had a VSWR of about 2.213 at a frequency of 380 MHz, a VSWR of 2.187 at a frequency of 520 MHz, a VSWR of about 1.874 at a frequency of 700 MHz, a VSWR of about 1.367 at a frequency of 960 MHz, a VSWR of about 1.089 at a frequency of 1.71 GHz, a VSWR of about 1.056 at a frequency of 2.70 GHz, and a VSWR of about 1.265 at a frequency of 6 GHz.

FIG. 17 illustrates radiation patterns for Elevation Plane measured for the prototype antenna shown in FIG. 13 with the radome shown in FIG. 14 at frequencies of about 410 MHz, 710 MHz, 850 MHz, 1910 MHz, 2500 MHz, and 5500 MHz.

FIG. 18 illustrates antenna elements 602, 702, and 802 having different shapes that may be used in omnidirectional broadband antennas according to exemplary embodiments. As shown, the entire antenna element 102 has a cone shape that conically widens in a longitudinal direction. The antenna element 102 also has sides that taper in the opposite longitudinal direction to a point. The antenna element 102 has a circular base and sides that conically taper from the circular base to a point in this example.

In other exemplary embodiments, the antenna element may be shaped or configured differently. Rather than the entire antenna element being cone shaped, the antenna element may include only a portion or section that is substantially conical, substantially pyramidal, and/or that tapers in a longitudinal direction. For example, an antenna element may include a portion having a cone or pyramid shape and/or having sides that taper in the longitudinal direction to a point.

With continued reference to FIG. 18, the antenna element 602 includes a first portion 603 that is conical and a second portion 605 that is frustoconical. The antenna element 702 includes a first portion 703 that is conical and a second portion 705 that is cylindrical. The antenna element 802 has a first portion 803 that has a hexagonal pyramidal shape and a second portion 805 that has a hexagonal shape.

Some of the example embodiments disclosed herein may provide an indoor omnidirectional (vertically polarized) antenna, designed for covering 380 MHz to 6 GHz bands. A combination of the parasitic patch ring and the antenna element disclosed herein may help to enhance the bandwidth down to 380 MHz. The antenna 100 may be in a compact form, for example, having a ground plate diameter of 250 mm or less, a height of 135 mm or less, and an end cap diameter of 130 mm or less. By way of example only, the prototype antenna shown in FIG. 14 has a compact form with a ground plate diameter of 250 mm, a height of 134 mm, and an end cap diameter of 120 mm. A parasitic element (e.g., grounded patch ring parasitic element, etc.) may be used to help increase the bandwidth at lower frequencies, while allowing for a smaller, more compact antenna design. Some example embodiments have a more compact size than existing antenna structures, while keeping compatible radio frequency (RF) performance. These antennas may have high performance including high gain, low ripple, and low VSWR. The grounded patch ring parasitic element may generate the 400 MHz band with enhanced bandwidth.

FIG. 19 shows an antenna 200 having a coaxial plug element 216 (e.g., PEM® RF stud connector, etc.) for a cable assembly. The antenna 200 includes a radiator or antenna element 202. The inventors hereof have recognized that although the antenna 200 may function satisfactorily for its intended purposes, the PIM source may still be relatively high at the galvanic contact by the PEM stud connector 216 and parasitic element. There may also be a PIM stability problem due to difficult controlled PEM connector 216 if the ground plane thickness is thin. Accordingly, the inventors hereof have developed and disclosed herein exemplary embodiments of capacitively grounded cable brackets (e.g., 518 (FIGS. 23-25), etc.) for broadband omnidirectional antennas (e.g., 300 (FIG. 20), 400 (FIG. 21), 500 (FIG. 23), etc.) that have a low PIM rated design or configuration.

FIG. 20 illustrates an exemplary embodiment of an omnidirectional broadband antenna 300 embodying one or more aspects of the present disclosure. As shown in FIG. 20, the antenna 300 includes a cup-shaped radiator or antenna element 302. The radiator 302 is based on a monopole antenna made of brass, aluminum, or other metal material. The cup-shaped monopole radiator may be fabricated via metal spinning, drawing, stamping parts, etc.

An electrically-conductive ring 306 is used to have the radiator excite at UHF band (380) from 380 MHz to 520 MHz. The electrically-conductive ring 306 surrounds at least a portion of the antenna element 302 and parasitically or capacitively couples to the antenna element 302. The electrically-conductive ring 306 is electrically connected and grounded to the ground plate 304 via a shorting leg or grounding pin 312. Accordingly, the electrically-conductive ring 306 may also be referred to as a grounded parasitic patch ring element.

The radiator 302 may be fed from the bottom. As shown in FIG. 20, the antenna 300 includes a coaxial plug element 316 (broadly, a connector) having an inner conductor and an outer conductor. But as described below, the radiator 302 may be fed from the bottom of the ground plane 304 via a coaxial cable 519 and a cable bracket 518 (FIG. 22) to improve PIM and/or provide a very good low PIM.

FIG. 21 illustrates another exemplary embodiment of an omnidirectional broadband antenna 400 embodying one or more aspects of the present disclosure. The antenna 400 includes a differently configured radiator 402 than the radiator 302 of antenna 300. In this example, the radiator 402 includes a cup shape defined by several stamped pieces (e.g., brass, aluminum, other metal, etc.) that are separated from each by a gap or spaced distanced therebetween.

The radiator 402 may be fed from the bottom. As shown in FIG. 21, the antenna 400 includes a coaxial plug element 416 (broadly, a connector) having an inner conductor and an outer conductor. But as described below, the radiator 402 may be fed from the bottom of the ground plane 404 via a coaxial cable 519 and a cable bracket 518 (FIG. 22) to improve PIM and/or provide a very good low PIM.

FIGS. 22 through 25 illustrate an exemplary embodiment of a cable bracket assembly 517 embodying one or more aspects of the present disclosure. The cable bracket assembly 517 may be configured or designed to provide stable low PIM performance. By using the cable bracket assembly 517, it may be a relatively simple process to solder a cable braid 516 of a coaxial cable 519.

FIG. 23 illustrates an exemplary embodiment of an antenna 500 that includes the cable bracket assembly 517. But the cable bracket assembly 517 may also be used with other antennas, such as the antenna 100 (FIGS. 1-3), 200 (FIG. 19), 300 (FIG. 20), 400 (FIG. 21), etc. As shown in FIG. 25, the cable bracket assembly 517 includes a cable bracket 517 and a capacitive grounding plane 524 (broadly, a capacitive grounding element or member) coupled to the cable bracket 517. An electrical insulator or dielectric material 520 is configured to be positioned between the cable bracket 517 and a ground plane 504 (broadly, a ground element or member) and between the capacitive ground plane 524 and the ground plane 504. Accordingly, the electrical insulator 520 separates and prevents direct electrical galvanic contact of the antenna ground plane 504 with either of the cable bracket 517 or the capacitive grounding plane 524.

The cable bracket is electrically insulated from an antenna ground plane 504 via a thin electrical insulator 520. A radiator antenna element 502 is fed from the bottom of the ground plane 504 via a coaxial cable 519 (broadly, a feed) and a cable bracket assembly 517 as shown in FIGS. 22, 24, and 25.

As shown in FIG. 23, the antenna 500 includes a radiator or antenna element 502. The antenna element 502 is fed from the bottom of the ground plane 504 via a coaxial cable 519 and the cable bracket 517. Accordingly, the coaxial cable 519 and the antenna element 502 are on opposite sides of the ground plane 504. An electrically-conductive ring or annular element 506 (broadly, an electrically-conductive element) surrounds at least a portion of the antenna element 502.

In this example, the electrically-conductive ring 506 is not electrically coupled directly to the antenna ground plane 504 via a shorting leg extending between the ring 506 and antenna ground plane 504. Instead, the capacitive ground plane 524 capacitively couples the ring 506 to the ground plane 504. As shown in FIG. 25, an electrically-conductive member or shorting leg 525 extends between and electrically couples the ring 506 to the capacitive ground plane 524. The ring 506 is spaced apart from and above the capacitive grounding plane 524. The capacitive grounding plane 524 capacitively couples to the antenna ground plane 504, thereby also coupling and grounding the ring 506 to the antenna ground plane 504.

In this example embodiment, the ring 506, capacitive ground plane 524, and electrically-conductive member or shorting leg 525 have a single-piece or monolithic construction. Alternative embodiments may include one or more (or all three) of the ring 506, capacitive ground plane 524, and electrically-conductive member or shorting leg 525 being a separate component or discrete piece that is attached to the others. The ring 506, capacitive ground plane 524, and electrically-conductive member or shorting leg 525 may include any suitable material, such as, for example, an electrically-conductive metal, electrically-conductive alloy, aluminum, brass, printed electrically-conductive ink on a dielectric, etc. By way of example only, cable bracket 518 may be made of brass, while the ground plane 504, ring 506, capacitive ground plane 524, and electrically-conductive member or shorting leg 525 may be made of aluminum.

As shown in FIG. 24, the cable bracket 518 is generally a planar or flat surface having two tabs 522*a*, 522*b* extending (e.g., stamped and integrally formed, etc.) from a bottom surface of the cable bracket 518. For example, the tabs 522*a*, 522*b* may be stamped from the cable bracket 518 and then bent at an angle (e.g., an acute angle, perpendicularly, etc.) relative to a bottom surface of the cable bracket 518. The cable bracket 518 and its tabs 522*a*, 522*b* may be configured to allow a cable braid of a coaxial cable to be soldered to the tabs 522*a*, 522*b* such that the cable braid does not galvanically contact the ground plane 504. The cable braid may thus be soldered to the tabs 522*a*, 522*b* without any direct galvanic contact between the cable braid and the ground plane 504. Accordingly, the cable bracket 518 and its tabs 522*a*, 522 may thus prevent or at least help reduce direct galvanic contact surface between the cable braid and the ground plane 504.

The tabs 522*a*, 522*b* are configured to have relatively small surfaces that will physically contact or touch the cable braid. This not only helps to achieve a stable low PIM, but may also reduce the risk of intermittent soldering wetting of the cable braid 516 (FIG. 22) to the cable bracket 518. Further, the cable bracket 518 has a large surface (e.g., the upper and lower flat or planar surfaces, etc.) that allows proximity grounding or ground proximity coupling of the cable bracket 518 to the ground plane 504, which are separated by the electrical insulator 520 (e.g., a thin layer of dielectric material, etc.) as shown in FIG. 25. The relatively large surface area of the cable bracket 518 may help ensure sufficient coupling is created to have proximity grounding between the cable bracket 518 and the ground plane 504. The cable bracket 518 may be coupled to the ground plane 504 with plastic fasteners or connectors, such as plastic rivets, heat staking, bolt and nuts, etc. By way of example, a diameter of the cable bracket ground surface may be about 85 millimeters (mm) in an exemplary embodiment.

The cable bracket 518 may define one or more slots 528 configured for plastic parts 526 (e.g., protrusions from a base 530 that extend through holes in the antenna ground plane 504, etc.) to pass through, and meanwhile does not impact performance of the design. The cable bracket 518 may further define one or more holes 532 for support pins 514 (FIG. 23) to pass through. The support pins 514 may extend between the electrically-conductive ring 506 and the ground plate 504. The support pins 514 may be configured to support the electrically-conductive ring 506 such that the electrically-conductive ring 506 is spaced apart from and generally parallel to the ground plate 504. The support pins 514 may comprise any material suitable for supporting the electrically-conductive ring 506, such as, for example, plastic, other dielectric materials, etc. Although FIG. 25 illustrates only one electrically-conductive member 525 extending between the ring 506 and capacitive ground plane 524 and four support pins 514, other embodiments may include more than one electrically-conductive member 525 and/or more or less than four support pins 514.

As shown in FIG. 25, the insulator 520 may be a dielectric adhesive thin tape (e.g., Thermal Transfer Polyester material, Thermal Transfer Polyamide material, FR-4 fiberglass reinforced epoxy laminate material, etc.) having a shape that generally matches the shape of the cable bracket 518 and the capacitive grounding plane 524 when coupled together. When the dielectric adhesive tape is disposed between the ground plane 504 and the cable bracket 518 and capacitive grounding plane 524, the dielectric adhesive tape prevents or at least inhibits direct galvanic contact of the ground plane 504 with the cable bracket 518 and with the capacitive grounding plane 524. See, for example, FIG. 25 where the insulator 520 includes two linked circular shapes corresponding in shape to the cable bracket 518 and capacitive grounding plane 524 and aligned for positioning between the ground plane 504 and the cable bracket 518 and capacitive grounding plane 524. The insulator 520 may have a thickness that falls within a range from about 0.1 mm to 0.2 mm (e.g., 0.1 mm, 0.15 mm, 0.2 mm, etc.).

The cable bracket 518 may be placed below the ground plane 504 or on top of the ground plane 504 depending on the needs of VSWR and available location arrangement.

FIG. 22 shows a cable braid 516 of a coaxial cable 519 soldered to the tabs 522*a*, 522*b* of the cable bracket 518. FIG. 22 also shows the relatively thin electrical insulator or dielectric material 520 disposed between the cable bracket 518 and the ground plane 504, to thereby separate, prevent direct galvanic contact between, and electrically insulate the cable bracket 518 from the ground plane 504.

FIG. 23 shows the cable bracket 518 and the capacitive grounding plane 524 placed on the ground plane 504. The capacitive grounding plane 524 is also electrically insulated from the ground plane 504 via the thin insulator 520.

The ground plane 504 may also define slots 538 and holes 540 aligned with the slots 534, 528 and holes 536, 532 respectively, configured for plastic parts 526 and support pins 514 to pass through. Further, the ground plane 504 may also include any suitable material for electrically grounding any connected components or received signals, such as, for example, an electrically-conductive brass, electrically-conductive alloy, electrically-conductive non-metal, electrically-conductive composite, aluminum, metalized plastic, printed electrically-conductive ink on a dielectric or non-conductive substrate, printed circuit board, etc.

Further, as shown in FIG. 25, the base 530 (e.g., plastic base plate, etc.) may include plastic parts or portions 526, support pins 514 configured to pass through slots 528, 534, 538 and holes 532, 536, 540 to retain or hold the ground plane 504, the insulator 520, and the cable bracket 518.

The electrical insulator 520 may also define slots 534 and holes 536 that are aligned with the corresponding slots 528 and holes 532 of the cable bracket 518, configured for plastic parts 526 and support pins 514 to pass through.

The capacitive ground plane 524 may also include holes to allow protruding portions 531 protruding outwardly from the base 530 to pass therethrough. Inserting the protruding portions 531 of the base 530 through holes in the antenna ground plane 504, electrical insulator 520, capacitive ground plane 524, and/or cable bracket 518 may help align the antenna ground plane 504, electrical insulator 520, capacitive ground plane 524, and cable bracket 518 relative to the base 530 and to each other.

FIGS. 26 through 33 provide results measured for a prototype Low PIM UHF-6 GHz SISO (single input, single output) antenna having the ground assembly shown in FIG. 25. These analysis results are provided only for purposes of illustration and not for purposes of limitation as other exemplary embodiments may be configured differently and/or have different performance.

FIG. 26 is an exemplary line graph of voltage standing wave ratio (VSWR) versus frequency measured for a prototype Low PIM UHF-6 GHz SISO (single input, single output) antenna having the ground assembly shown in FIG.

25. Generally, FIG. 26 shows that the prototype antenna is operable with good voltage standing wave ratio (VSWR), e.g., VSWR less than 2 for frequencies 698 MHz to 6 GHz, etc.

FIGS. 27, 28, and 29 are exemplary line graphs of intermodulation level (IM) in decibels relative to carrier (dBc) versus frequency in megahertz (MHz) showing the respective UHF band, low band, and high band PIM performance measured for the prototype Low PIM UHF-6 GHz SISO antenna having the ground assembly shown in FIG. 25. As shown, the prototype antenna has low PIM performance (e.g., less than −150 dBc, etc.) for the UHF band, Low Band, and High Band. Generally, these results show that the prototype antenna had good PIM performance, e.g., at 1921 MHz band, 700 MHz band, 380 MHz, etc. even though it is usually more difficult to achieve reasonable PIM level at lower frequency bands.

FIGS. 30 through 33 illustrate radiation patterns for Azimuth Plane (Theta=0°), Phi 0° plane (Phi=0°), and Phi 90° Plane (Phi=0°) measured for the prototype Low PIM UHF-6 GHz SISO antenna having the ground assembly shown in FIG. 25 at respective frequencies of 430 MHz (FIG. 30), 850 MHz (FIG. 31), 2100 MHz (FIG. 32), and 5000 MHz (FIG. 33). Generally, FIGS. 30 through 33 show the quasi-omnidirectional radiation pattern and good efficiency of the antenna 500. Accordingly, the antenna 500 has a large bandwidth that allows multiple operating bands for wireless communications devices, including FDD and TDD LTE frequencies or frequency bands. In addition, the antenna 500 of this exemplary embodiment has low PIM.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail. In addition, advantages and improvements that may be achieved with one or more exemplary embodiments of the present disclosure are provided for purpose of illustration only and do not limit scope of the present disclosure, as exemplary embodiments disclosed herein may provide all or none of the above mentioned advantages and improvements and still fall within the scope of the present disclosure.

Specific dimensions, specific materials, and/or specific shapes disclosed herein are example in nature and do not limit the scope of the present disclosure. The disclosure herein of particular values and particular ranges of values for given parameters are not exclusive of other values and ranges of values that may be useful in one or more of the examples disclosed herein. Moreover, it is envisioned that any two particular values for a specific parameter stated herein may define the endpoints of a range of values that may be suitable for the given parameter (i.e., the disclosure of a first value and a second value for a given parameter can be interpreted as disclosing that any value between the first and second values could also be employed for the given parameter). For example, if Parameter X is exemplified herein to have value A and also exemplified to have value Z, it is envisioned that parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, and 3-9.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The term "about" when applied to values indicates that the calculation or the measurement allows some slight imprecision in the value (with some approach to exactness in the value; approximately or reasonably close to the value; nearly). If, for some reason, the imprecision provided by "about" is not otherwise understood in the art with this ordinary meaning, then "about" as used herein indicates at least variations that may arise from ordinary methods of measuring or using such parameters. For example, the terms "generally," "about," and "substantially," may be used herein to mean within manufacturing tolerances.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements, intended or stated uses, or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An omnidirectional broadband antenna comprising:

a ground element;

an antenna element electrically isolated from the ground element, an annular element surrounding at least a portion of the antenna element and parasitically coupled to the antenna element;

a cable bracket capacitively grounded to the ground element, whereby the cable bracket is configured to allow soldering of a cable braid to the cable bracket for feeding the antenna element without direct galvanic contact between the cable braid and the ground element;

a capacitive grounding element configured for capacitively coupling the annular element to the ground element; and an electrical insulator between the cable bracket and the ground element and between the capacitive grounding element and the ground element, whereby the electrical insulator inhibits direct galvanic contact of the ground element with the cable bracket and the capacitive grounding element.

2. The omnidirectional broadband antenna of claim 1, wherein:

the annular element is spaced apart from the capacitive grounding element;

an electrically-conductive member extends between and electrically couples the annular element to the capacitive grounding element;

the annular element, the capacitive grounding element, and the electrically-conductive member are made of aluminum or have a single piece, monolithic construction; and the cable bracket, the annular element, the capacitive grounding element, and the electrically-conductive member do not make direct galvanic contact with the ground element.

3. The omnidirectional broadband antenna of claim 1, further comprising a base including one or more protruding portions protruding outwardly from the base, wherein the ground element, the cable bracket, the capacitive grounding element, and the electrical insulator include openings for receiving the one or more protruding portions of the base therethrough.

4. The omnidirectional broadband antenna of claim 1, further comprising a coaxial cable including a cable braid soldered to the cable bracket for feeding the antenna element from a bottom of the antenna element without any direct galvanic contact between the cable braid and the ground element, wherein the coaxial cable and the antenna element are on opposite sides of the ground element.

5. The omnidirectional broadband antenna of claim 1, wherein the cable bracket comprises one or more tabs to which a cable braid is solderable.

6. The omnidirectional broadband antenna of claim 5, wherein the one or more tabs are configured to have surfaces to contact the cable braid to help achieve stable low passive intermodulation or help reduce a risk of intermittent soldering wetting of the cable braid to the cable bracket.

7. The omnidirectional broadband antenna of claim 5, wherein the cable bracket is configured to be proximity grounded to the ground element.

8. The omnidirectional broadband antenna of claim 1, wherein the ground element, the antenna element, the annular element, and the cable bracket are made of non-ferromagnetic material.

9. The omnidirectional broadband antenna of claim 1, wherein the omnidirectional broadband antenna is operable with low passive intermodulation within one or more frequency ranges.

10. An omnidirectional broadband antenna comprising:

a ground element;

an antenna element electrically isolated from the ground element, an annular element surrounding at least a portion of the antenna element and parasitically coupled to the antenna element; and a cable bracket capacitively grounded to the ground element, whereby the cable bracket is configured to allow soldering of a cable braid to the cable bracket for feeding the antenna element without direct galvanic contact between the cable braid and the ground element;

wherein the omnidirectional broadband antenna is operable with a passive intermodulation less than −150 decibels relative to carrier (dBc) from about 380 megahertz to about 2700 megahertz.

11. The omnidirectional broadband antenna of claim 10, further comprising:

a capacitive grounding element configured for capacitively coupling the annular element to the ground element; and an electrical insulator between the cable bracket and the ground element and between the capacitive grounding element and the ground element, whereby the electrical insulator inhibits direct galvanic contact of the ground element with the cable bracket and the capacitive grounding element.

12. A cable bracket assembly for an antenna, the cable bracket assembly comprising:

a cable bracket configured to be capacitively grounded to a ground element of the antenna, the cable bracket configured to allow soldering of a cable braid to the cable bracket for feeding an antenna element of the antenna without direct galvanic contact between the cable braid and the ground element;

an annular element configured to be positioned around at least a portion of the antenna element and parasitically coupled to the antenna element;

a capacitive grounding element configured for capacitively coupling the annular element to the ground element;

an electrically-conductive member extending between and electrically coupling the annular element to the capacitive grounding element; and an electrical insulator configured to be positioned between the cable bracket and the ground element and between the capacitive grounding element and the ground element, to inhibit direct galvanic contact of the ground element with the cable bracket and the capacitive grounding element.

13. The cable bracket assembly of claim 12, wherein the cable bracket, the annular element, the capacitive grounding element, and the electrically-conductive member are made of non-ferromagnetic material.

14. The cable bracket assembly of claim 12, wherein the annular element, the capacitive grounding element, and the electrically-conductive member have a single piece, monolithic construction.

15. The cable bracket assembly of claim 12, wherein the cable bracket, the capacitive grounding element, and the electrical insulator include openings for receiving one or more protruding portions protruding outwardly from a base of the antenna.

16. The cable bracket assembly of claim 12, wherein the cable bracket comprises one or more tabs to which a cable braid is solderable.

17. The cable bracket assembly of claim 16, wherein the one or more tabs are configured to have surfaces to contact the cable braid to help achieve stable low passive intermodulation or help reduce a risk of intermittent soldering wetting of the cable braid to the cable bracket.

18. The cable bracket assembly of claim 16, wherein the cable bracket is configured to be proximity grounded to the ground element.

* * * * *